US005323221A

United States Patent [19]

Tomimori et al.

[11] Patent Number: 5,323,221

[45] Date of Patent: Jun. 21, 1994

[54] SHEET PROCESSING APPARATUS

[75] Inventors: Koshiro Tomimori; Masahiro Watashi, both of Osaka, Japan

[73] Assignee: Mita Industrial Co., Ltd., Osaka, Japan

[21] Appl. No.: 983,234

[22] Filed: Nov. 30, 1992

[30] Foreign Application Priority Data

Nov. 29, 1991 [JP] Japan ..... 3-316353
Nov. 29, 1991 [JP] Japan ..... 3-316354
Nov. 29, 1991 [JP] Japan ..... 3-316355

[51] Int. Cl.[5] ..... G03G 21/00
[52] U.S. Cl. ..... 355/324; 355/202
[58] Field of Search ..... 355/324, 321, 200, 202; 346/29, 49, 50, 51

[56] References Cited

U.S. PATENT DOCUMENTS 4,959,685 9/1990 Kato ..... 355/72
4,994,865 2/1991 Nishimori et al. ..... 355/324
5,012,297 4/1991 Yamashita et al. ..... 355/321
5,060,921 10/1991 Higashio et al. ..... 355/324 X

FOREIGN PATENT DOCUMENTS 61-94789 5/1986 Japan ..... 355/324

*Primary Examiner*—Fred L. Braun

*Attorney, Agent, or Firm*—Beveridge, DeGrandi, Weilacher & Young

[57] ABSTRACT

A compact sheet processing apparatus mountable on the side of a copying machine body processes sheets discharged therefrom. The apparatus includes a sheet supplier for supplying sheets received from the copying machine body; a sheet discharger; a first transport route connecting the sheet supplier and discharger, and a sheet-stamping mechanism disposed opposite the sheet-bearing surface of the first transport route. Further included is a second transport route, diverging from and extending below the first transport route, which feeds sheets to a punching mechanism disposed therein; a transport drive providing controlled transport of sheets in each transport route; and a process timing control unit. The sheets are transported along both the first and second transport routes wherein the stamping and punching operations are both to be carried out, and then discharged through the discharger. The timing of the processes is controlled according to set conditions. Transport within the reduced-dimension apparatus is such that wherein holes are punched into a sheet in the punching mechanism, drive in a latter-stage unit such as a sorter mounted at the discharger need only be halted, a reversing capability or the like thereof thus being unnecessary.

38 Claims, 17 Drawing Sheets

SHEET PROCESSING APPARATUS

BACKGROUND OF THE INVENTION

The present invention relates to a sheet processing apparatus. More specifically, it relates to a sheet processing apparatus which can be mounted on the side of an image forming apparatus and which performs processes such as stamping on sheets discharged from the image forming apparatus.

For example, a copying machine may have a mechanisms for performing a stamping process and for punching holes in copy-processed sheets. In such a copying machine, the stamping mechanism and the punching mechanism are disposed downstream of a fixing unit. The stamping mechanism will include stamps, or a stamp unit comprising, for example, a thermal head or an ink ribbon, as a stamping member, as well as a mechanism for pressing either onto a sheet. Where sheet-stamping is performed, transportation of the image-fixed sheet is halted and the stamp or the stamp unit is pressed onto the sheet. Wherein holes are punched in a sheet, it the sheet is transported to a predetermined position, and then held so as to be punched by the punching mechanism.

It the copying machine equipped with the stamping mechanism, stamping can be performed along the leading or the trailing margin of a sheet by accordingly regulating the transportation of the sheet. More specifically, the stamp position is variable in the sheet transport direction. However, wherein stamps are employed for performing stamping operations, the stamp position cannot be varied in the width direction of the sheet. On the other hand, wherein the stamp unit containing a thermal head is used, the stamping position can be made variable in the sheet width direction by providing a head which extends accordingly and controlling each element thereof. Such an apparatus, however, is expensive and its control is complicated.

Still further, since this conventional sheet processing apparatus is provided between the fixing unit and discharge rollers within the body of a copying machine, it is impractical to fit the stamping mechanism to a copying machine not previously equipped with a stamping function.

In a copying machine equipped with the foregoing stamping and punching mechanisms, the distance from the fixing unit to the discharge rollers is increased, due to the location of the mechanisms in line along the transport path of the sheet. The machine thus outfitted is made bulkier, and additional time is required to discharge a sheet, even wherein the stamping and punching processes are not carried out.

In one means of disposing the stamping and punching mechanisms in a reduced space, the leading edge of a copy sheet is fed into a latter-stage unit, for example a sorter, during the operations performed by each mechanism. In this case, further process control in the operation of the latter-stage unit during the functioning of each mechanism becomes necessary.

Furthermore, since the stamping and punching mechanisms operate at different timings, extra time is spent in performing these processes.

SUMMARY OF THE INVENTION

It is an object of the present invention to facilitate the changing of the stamping position along the sheet width direction through an inexpensive structure.

It is another object of the present invention to enable a stamping function to be readily added to an image forming apparatus having no stamping mechanism.

It is still another object of the present invention to enable the stamps to be changed easily and inexpensively.

It is a further object of the present invention to enable the stamping and punching operations to be performed in a reduced space in the sheet transport direction.

It is a still further object of the present invention to reduce space in the sheet transport direction, and to simplify control of a sheet processing latter-stage unit providing another function.

It is a still further object of the present invention that in providing two processing means, such as a stamping and a punching mechanism, the space in the sheet transport direction is reduced and processing time is shortened.

(1) A sheet processing apparatus according to an aspect of the present invention, operative on a sheet discharged from an image forming apparatus, includes a sheet supplier, a sheet discharger, a sheet transport mechanism comprising a transport path disposed between the sheet supplied and the sheet discharger, and a stamping mechanism, which performs a stamping operation on sheets in transport along the transport path, comprising stamp units of which positions into which they are set for operation are variable in the sheet width direction.

Herein, sheets discharged from the image forming apparatus are supplied into the sheet processing apparatus. The sheets are transported to the sheet discharger through the transport path and then discharged outside the apparatus. The sheets are stamped by the stamp units during transportation. The stamping position of the stamp units can be changed along the sheet width direction. Consequently, sheets can be stamped at any widthwise position. Moreover, the apparatus is less expensive in comparison to structures using a thermal head. Since this apparatus includes both the sheet supplier and discharger, a stamping capability can be readily provided to a copying machine by mounting the apparatus at the sheet discharger.

(2) In another aspect of the present invention, the stamp unit of the stamping mechanism has a plurality of stamp surfaces such that selectively, they each in turn may be put opposite the sheet-transport surface of the transport path.

Consequently, the stamps can be readily changed by switching the stamp surfaces which are opposite the transport path.

(3) A sheet processing apparatus according to a further aspect of the present invention includes a first transport route, a first processing mechanism, a second transport route, a second processing mechanism, and a transport mechanism. The first transport route connects the sheet supplier to the sheet discharger. The first processing mechanism is provided so as to be opposite a sheet in the first transport route and performs a first process on the sheet. The second transport route diverges from and extends below the first transport route. The second processing mechanism is provided so as to be opposite a sheet in the second transport route. The transport mechanism transports sheets along the first and second transport routes.

In this aspect, the sheet from the image forming apparatus is supplied to the sheet supplier. The sheet is transported along the first transport route or the first and second transport routes and then discharged from the sheet discharger. In the first transport route, the first processing can be performed on the sheet and in the second transport route, the second processing can be performed.

Specifically, the first and second processing mechanisms are thus vertically arranged. Therefore, the space in the sheet transport direction is reduced, in comparison with conventional apparatus in which the two processing mechanisms are arranged linearly along a single transport path. Wherein neither process it to be performed, since the sheet is then transported directly through the short first transport route, transporting time is shortened.

(4) A sheet processing apparatus according to a still further aspect also includes a process designating means for designating the processes to be performed on sheets, and a loop-forming section. When the second process is designated by the process designating means, a portion of a sheet in transport in the first transport route is curled in the loop-forming section into a loop of length corresponding to the distance from the divergence point of the first transport route, to the trailing edge of a sheet wherein it is positioned in the second transport route for processing by the second processing mechanism, such that and until the trailing edge of the sheet in transport is brought just forward of the divergence point of the first transport route.

In this aspect, the first process is performed by the first processing mechanism on a sheet being transported along the first transport route. When the second process is to be performed, the sheet is transported along the first transport route, and then a portion of it is stopped, nipped at a predetermined position, wherein transport of the sheet is continued until its trailing edge passes through the divergence point. Then, the sheet is transported in the reverse direction, such that its trailing edge is thus guided, and the sheet is thus transported into the second transport route. Then, the second process is performed on the sheet in the second transport route by the second processing mechanism.

More specifically, when the trailing edge of the sheet is at the diverging point of the first transport path, a portion of the sheet will have been curled into a loop of the aforedescribed length, corresponding to the distance from the junction of the first and second transport routes to the trailing edge of the sheet wherein it is processed by the second processing mechanism, in a space provided along a section of the transport path. Then when the trailing edge of the sheet has passed the junction, it is transported in the reverse direction the length of the loop, whereby the trailing edge of the sheet is accordingly supplied to the second processing mechanism.

Thus, since transport of the sheet is controlled within the apparatus while the sheet is processed, even wherein a latterstage unit such as a sorter is provided the apparatus, the unit need only be on/off controlled, consequently simplifying sheet processing.

(5) According to a still further aspect of the present invention, a sheet processing apparatus further includes a control unit for operating the first and second processing mechanisms simultaneously, wherein a sheet is at once positioned opposite each mechanism.

In this aspect, wherein the first and second processes are to be performed on a sheet, the sheet is positioned in both the first and second transport routes, opposite both the first and second processing mechanisms. In this state, both processing mechanisms are operated simultaneously.

Thus, processing time is shortened. Furthermore, since the first and second processing mechanisms are disposed one over the other, in that they are in corresponding positions opposite the respective first transport route, and the second diverging therefrom and extending therebelow, occupied space in the sheet-transporting direction is minimized.

These and other objects and advantages of the present invention will be more fully apparent from the following detailed description.

DETAILED DESCRIPTION OF THE PREFERRED EMBODIMENT

Overall Structure

Figure 1:
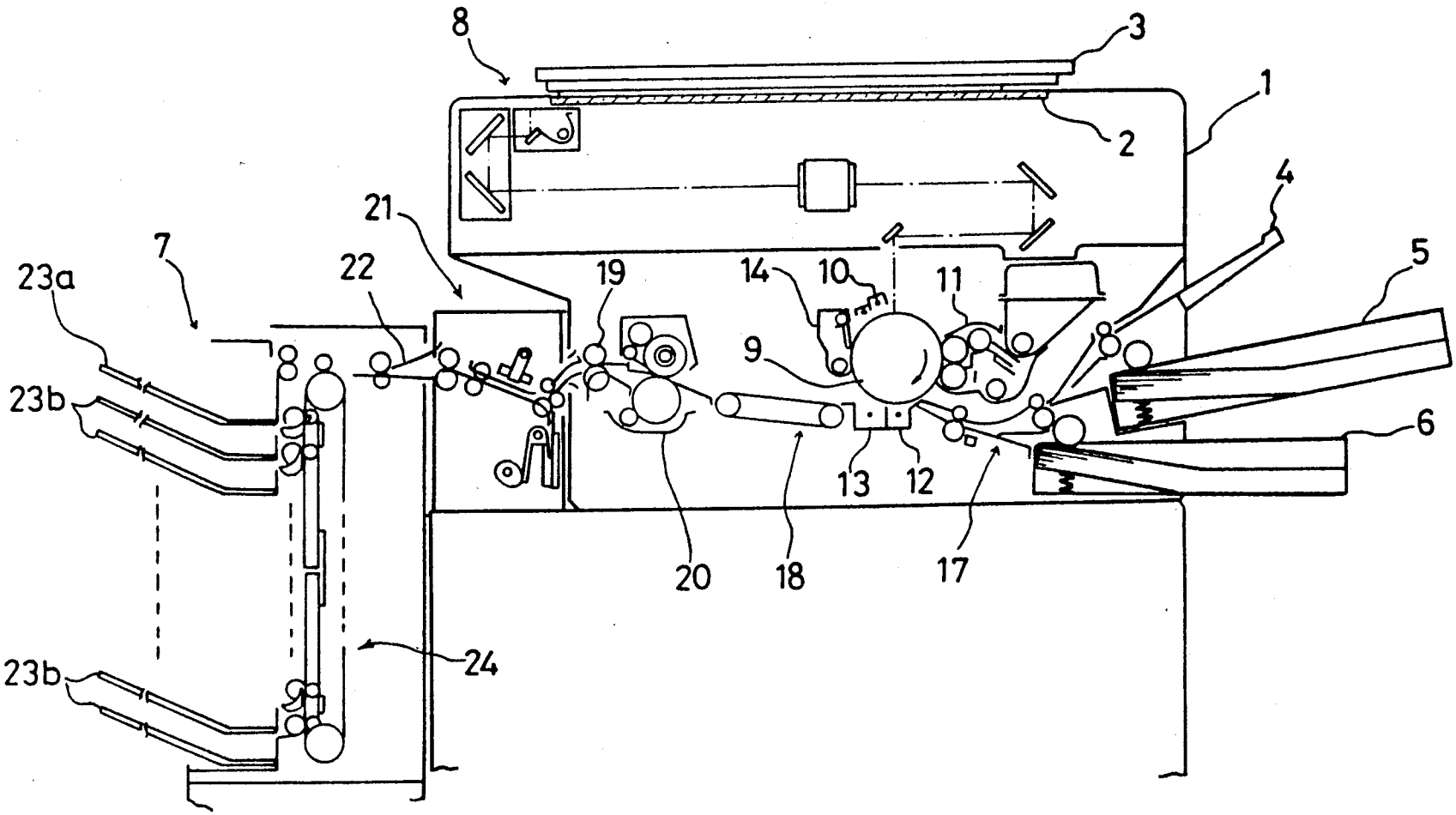
FIG. 1 is a schematic vertical section view of a copying machine comprehending a sheet processing apparatus according to an embodiment of the present invention.

Referring to FIG. 1, a copying machine body 1 is shown to include an original support 2 in its upper surface, and an original cover 3 openably disposed on the original support 2. On the right of the body 1 in the figure, a bypass tray 4 and a pair of feed cassettes 5 and 6 are detachably mounted. On the left of the body 1, a stamp and punch apparatus 21 according to an embodiment of the present invention is disposed. In addition, on the left of the stamp and punch apparatus 21, a sorter 7 is disposed.

An optical exposure system 8 for reading an original is provided in an upper portion of the interior of the copying machine body 1. The optical exposure system 8 includes a light source, mirrors and lenses. Disposed in the central part of the body 1 is a photoconductive drum 9 on which an electrostatic latent image is formed. Surrounding the photoconductive drum 9, there are a main charger 10 for charging the photoconductive drum 9 with a predetermined level of electric charge, a developing unit 11 for developing an electrostatic latent image, a transfer unit 12 for transferring a toner image to a sheet, a detach unit 13 for detaching a sheet from the photoconductive drum 9, and a cleaning unit 14 for removing toner from the photoconductive drum 9, in that order.

A sheet transport path 17 extends from the bypass tray 4 and feed cassettes 5 and 6 to the image forming unit consisting of the photoconductive drum 9 and other elements. A sheet discharging path 18 is provided on the left of the image forming unit. A fixing unit 20 for fixing a transferred image onto a sheet, and discharge rollers 19 for discharging the image-fixed sheet to the stamp and punch apparatus, are disposed between the sheet transport path 18 and the stamp and punch apparatus 21.

The sorter 7 includes a sheet transport path 22 for receiving a sheet from the stamp and punch apparatus, a plurality of bins 23*a* and 23*b* vertically disposed at given intervals, and a sorting mechanism 24 disposed between the transport path 22 and the bins 23*a* and 23*b*. The bin 23*a* is a non-sorting bin and the bins 23*b* are sorting bins disposed under the bin 23*a*.

Stamp and punch apparatus

Figure 2:
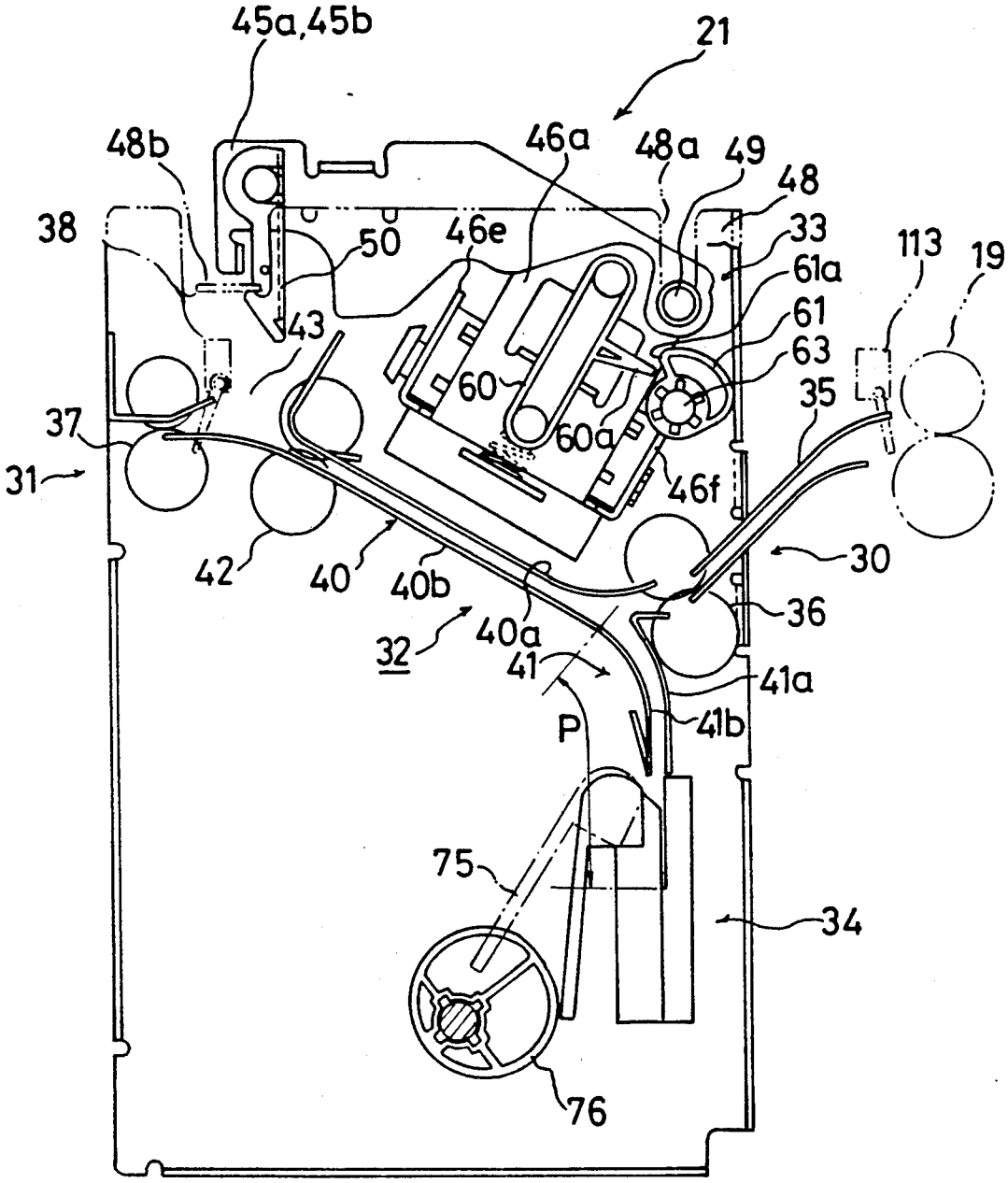
FIG. 2 is a schematic vertical section view of a stamp and punch apparatus as the sheet processing apparatus.

As shown in FIG. 2, the stamp and punch apparatus 21 includes a sheet supplier 30 for receiving a sheet from the copying machine body 1 and supplying it into the apparatus, a sheet discharger 31 provided on the opposite end of the apparatus, for discharging the sheet to the sorter 7, a transport path 32 disposed between the sheet supplier 30 and the sheet discharger 31, a stamping mechanism 33, and a punching mechanism 34 for forming punch holes at the feed-trailing edge of a sheet.

The sheet supplier 30 includes a guide path 35, one of which end extends into the copying machine body 1, and guide rollers 36 disposed at the other end of the guide path 35. The sheet discharger 31 includes discharge rollers 37, and a sheet discharge switch 38 provided adjacent and to the right of the discharge rollers.

The transport path 32 includes a first transport route 40 for transporting the sheet from the guide rollers 36 to the discharge rollers 37, and a second transport route 41 diverging from the first transport route 40. The first transport route 40 inclines upward from the guide rollers 36 toward the discharge rollers 37 and includes an upper guide plate 40*a* and a lower guide plate 40*b* spaced from the upper guide plate 40*a* at a predetermined distance. Transport rollers 42 are provided onto the right of the discharge rollers 37 in the way of the first transport route 40. The lower guide plate 40*b* extends to the discharge rollers 37, whereas the upper guide plate 40*a* does not continue part the left of the transport rollers 42. Therein, a loop forming space 43 is provided between the discharge rollers 37 and the transport rollers 42 in which the feed-leading edge of a sheet may be curved, i.e., formed into a loop. The second transport route 41 diverges below the first transport route 40, whereby the trailing edge of a sheet may be guided downward when transported from the first transport 40 in the reverse direction. The path diverging point (i.e., the junction of the routes) is made adjacent the guide rollers 36 and is at the lower end of the first transport route 40. The second transport route 41 includes a first guide plate 41*a* and a second guide plate 41*b* joined to the lower guide plate 40*b* of the first transport route 40. The upper edge of the first guide plate 41*a* is bent horizontally, whereby a sheet fed from the guide rollers 36 is guided toward the first transport route 40.

Stamping mechanism

Figure 3:
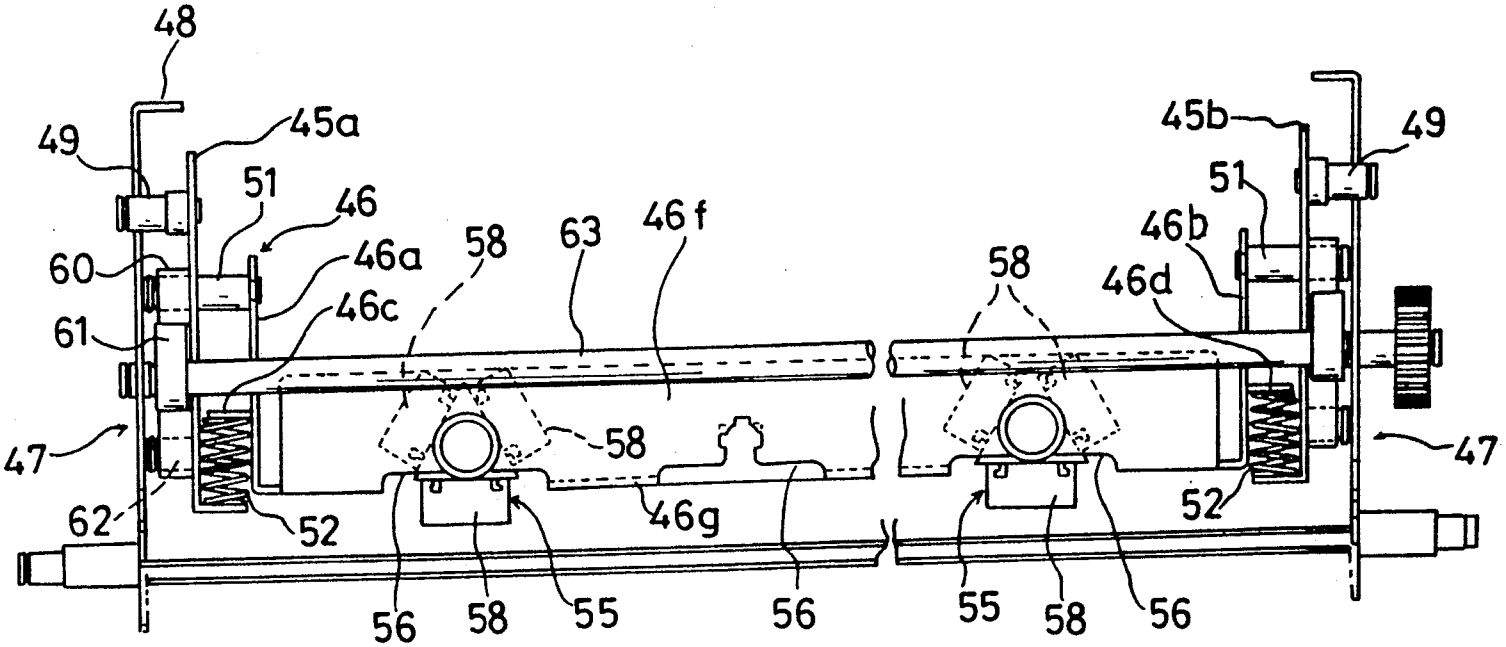
FIG. 3 is a partial end view of the stamp and punch apparatus.

As shown in FIGS. 2 and 3, the stamping mechanism 33 is disposed above the first transport route 40 between the guide rollers 36 and the transport rollers 42. The stamping mechanism 33 includes a pair of pivotal frames 45*a* and 45*b* which are provided opposed along the front and rear sides of the apparatus, a vertically movable stamp supporting frame 46 provided between the pair of pivotal frames 45*a* and 45*b*, a stamp unit 55 attached onto the supporting frame 46, and a stamp operating mechanism 47 for operating the stamp supporting frame 46.

Figure 4:
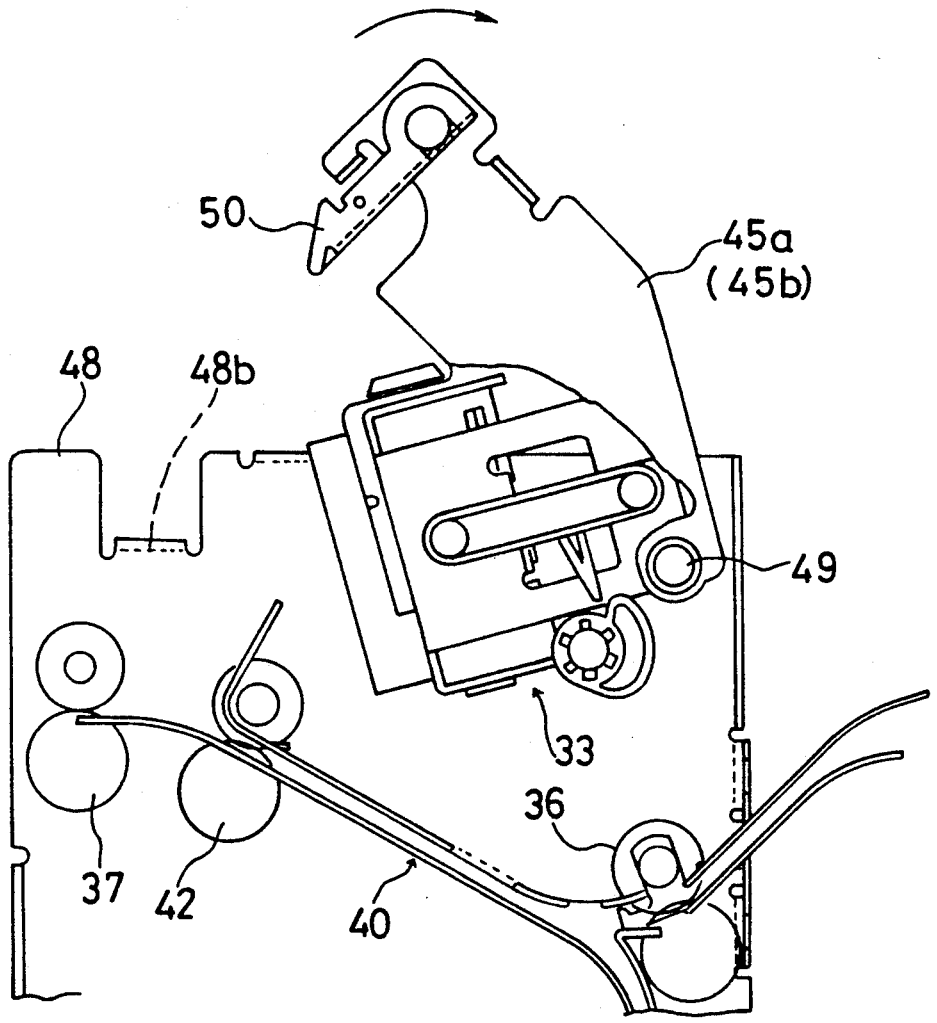
FIG. 4 is a view illustrating a stamping mechanism of the stamp and punch apparatus in operation.

One end of each of the pivotal frames 45*a* and 45*b* on the sheet-entrance side is hinged to the frame 48 of the stamp and punch apparatus 21 by a pin 49. The pin 49 is supported in a cutout 48*a* (referring to FIG. 2) formed in the frame 48. A turnable latch 50 is provided at the free end of each of the pivotal frames 45*a* and 45*b* on the sheet-discharging side, and is engaged with a catch 48*b* of the frame 48. Therefore, when engagement of the latch 50 with the catch 48*b* is released, the pivotal frames 45*a* and 45*b* can be moved to the position shown in FIG. 4, beyond which they can be further turned 90° clockwise from the position shown in FIG. 4. In this state, the stamp unit surface opposite the first transport route 40 can be on the upper side.

The stamp supporting frame 46 is formed like an open-ended box, and includes end walls 46*a* and 46*b* opposite the pivotal frames 45*a* and 45*b* at predetermined intervals, respectively. Pins 51 extending outward are fixed at the upper ends of the end walls 46*a* and 46*b*. Either pin 51 penetrates a corresponding of the pivotal frames 45*a* and 45*b*. A slot in each of the pivotal frames 45*a* and 45*b* through which the pin 51 penetrates extends vertically, whereby the pin 51 can vertically move through a predetermined range. Projections 46*c* and 46*b* extending outward are formed in the vertical middle of the respective end walls 46*a* and 46*b* of the stamp supporting frame 46. Meanwhile, a lower end of each of the pivotal frames 45*a* and 45*b* is bent inward (toward the stamp supporting frame) and a return spring 52 composing the stamp operating mechanism 47 is disposed between the bent portion and each of the projections 46*c* and 46*d* of the stamp supporting frame 45, whereby the stamp supporting frame 46 is always impelled upward.

In both side walls 46*e* and 46*f* of the stamp supporting frame 46 in the sheet-transport direction, a plurality of stamp unit retainers 56 to which stamp units 55 are attached are arranged in the sheet width direction. The stamp unit retainer 56 and the stamp unit 55 will be described later. A plurality of holes for stamping are formed on the bottom wall 46g of the stamp supporting frame 46, corresponding to the plurality of stamp unit retainers 56.

The stamp operating mechanism 47 includes the aforementioned return spring 52, a lifting unit 60, and a cam 61. One end of the lifting unit 60 abuts on the pin 51 projecting outward from the stamp supporting frame 46, the other end abutting on a pin 62 projecting outward from the pivotal frame 45a; and a stop 60a projects toward the sheet-entrance side as shown in FIG. 2. The cam 61 has a catch 61a in its periphery, and is fixed to both ends of an axle 63 rotatably supported to the frame 48. The catch 61a abuts on the stop 60a of the lifting unit 60. In this structure, while the cam 61 rotates once, first, the catch 61a of the cam 61 abuts on the stop 60a of the lifting unit 60, then the stop 60a comes out of abutment on the catch 61a, after the lifting unit 60 goes down by a predetermined distance. Then, the lifting unit 60 is returned upward by the return spring 52 through the stamp supporting frame 46 and the pin 51. The stamp operating mechanism 47 is provided in the front and rear sides of the apparatus, respectively.

Figure 5:
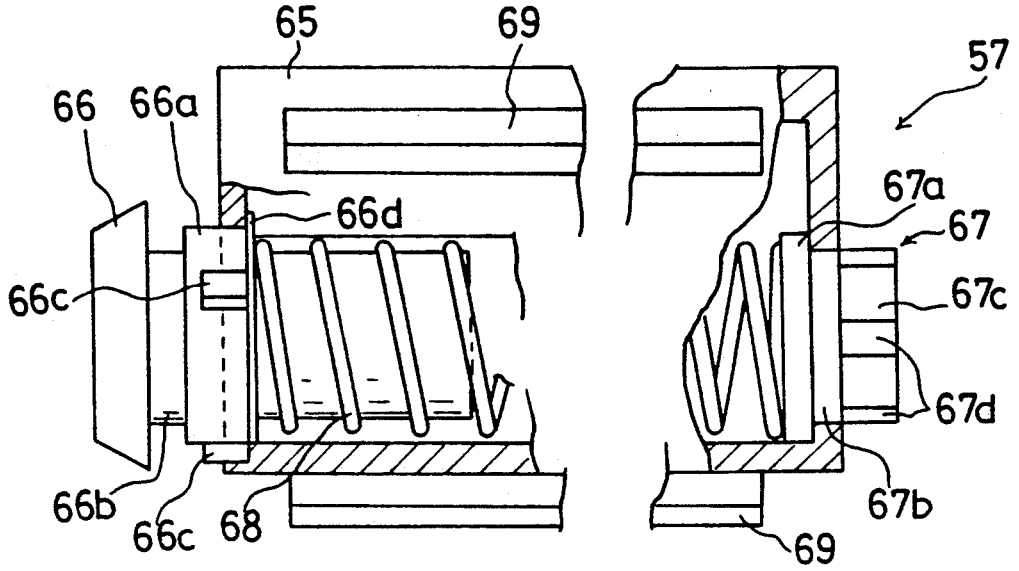
FIG. 5 is a partial section view of a stamp holder.
Figure 6:
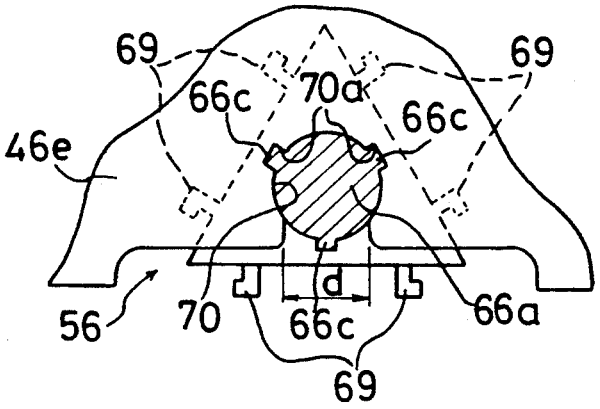
FIG. 6 is a partial view showing a state in which the stamp holder is mounted.
Figure 7:
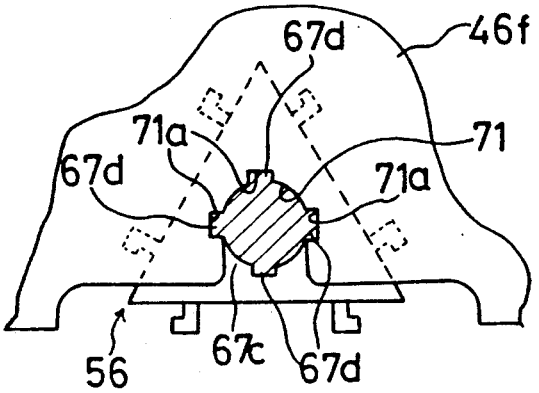
FIG. 7 is another partial view showing a state in which the stamp holder is mounted.

The stamp unit 55 includes a stamper mount 57 as shown in FIG. 5 and an inking stamper 58 (referred to simply as a stamper hereinafter) which is detachably mounted on the stamper mount 57. The stamper mount 57 includes a body 65 having a shape of a triangular prism, a first engager 66 slidably mounted on one side of the body 65, a second engager 67 mounted opposite the first engager 66, and a spring 68 disposed between the first and second engagers 66 and 67. As can be seen from FIGS. 3, 6 and 7, the body 65 is triangular in cross-section, and has claws 69 used for mounting the stamper 58 formed on each of the three sides. The first engager 66 includes a large-diameter segment 66a, a smaller diameter segment 66b, and a retainer 66d. As can be seen from FIG. 6, three nubs 66c projecting at equal-angle intervals are formed on the periphery of the large-diameter segment 66a. The first engager 66 held against rotation with respect to the body 65 by means of the nubs 66c. The second engager 67 includes a flange 67a disposed inside the body 65, a large-diameter segment 67b, and a small-diameter segment 67c. As can be seen from FIG. 7, the small-diameter segment 67c has four nubs 67d projecting outward at equal-angle intervals.

The stamp unit retainer 56 to which the stamp unit 55 is attached is formed by receptacles 70 and 71 (referring to FIGS. 6 and 7) formed in the side walls 46e and 46f of the stamp supporting frame 46. The small-diameter segment 66b of the first engager 66 can pass through a width d of an opening of the receptacle 70 formed in the side wall 46e, but the large-diameter segment 66a cannot. The large-diameter segment 66a of the first engager 66 can be engaged with an inner portion of the opening, and two cutouts 70a capable of engaging with the nubs 66c of the first engager 66 are formed at the upper portions. Meanwhile, the small diameter portion 67c of the second engager 67 can be engaged with the receptacle 71 formed in the side wall 46f, wherein three cutouts 71a capable of engaging with the projections 67a of the second engager 67 are formed; more specifically, one is formed at upper portion and two are formed at lateral portions.

Thus, the first and second engagers 66 and 67 of the stamper mount 57 and the receptacles 70 and 71 of the stamp supporting frame 46 constitute a linking mechanism by which the stamp holder body 65 is allowed to turn or not.

Punching mechanism

The punching mechanism 34 is disposed at a lower portion of the sheet supplier 30 of the stamp and punch apparatus 21 and its sheet entrance portion is connected to the second transport route 41. The punching mechanism 34 comprises a lever 75 and a punch (not shown) operated by the lever 75. The lever 75 is driven by an eccentric wheel 76 rotatably mounted on a bottom portion of the stamp and punch apparatus 21.

Drive mechanism

Figure 8:
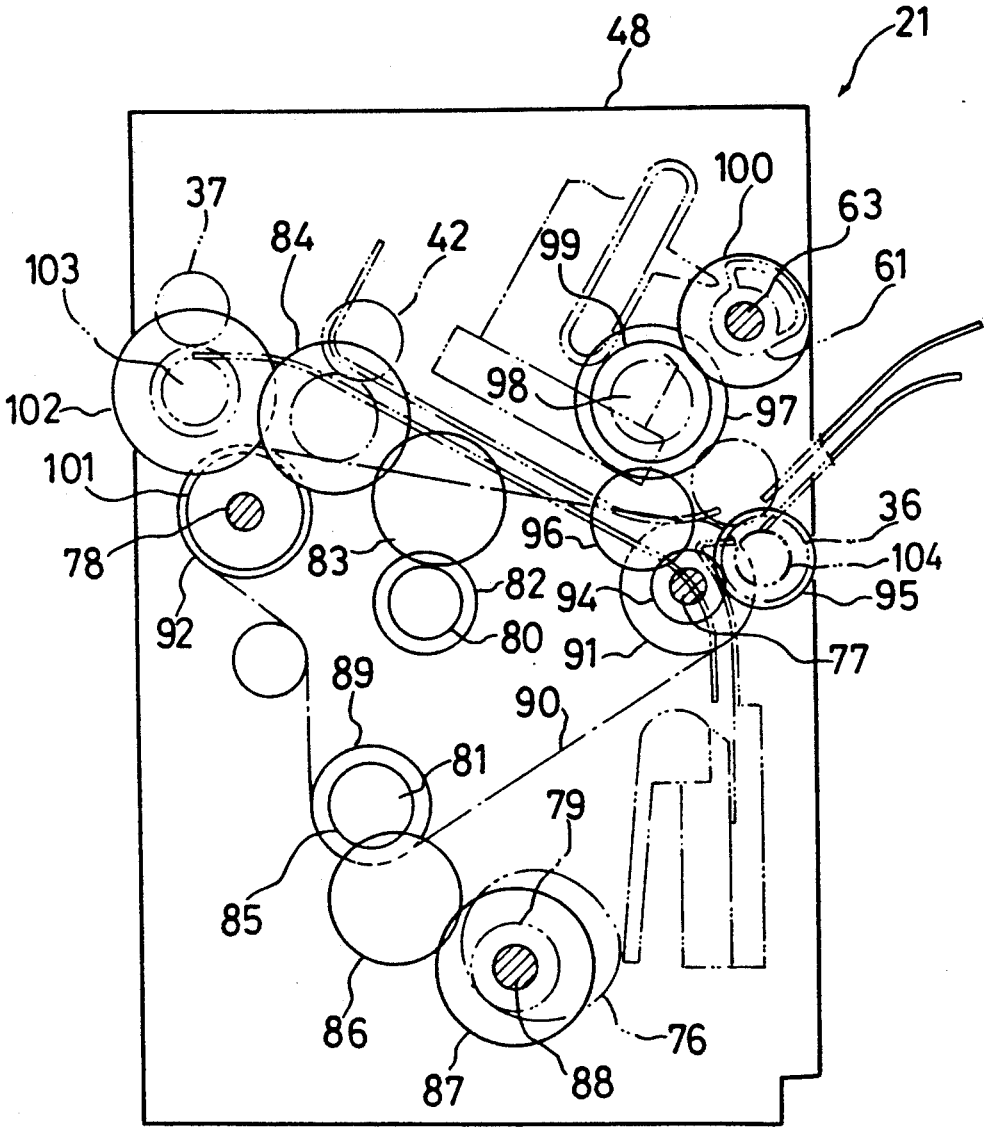
FIG. 8 is a view showing a drive mechanism of the stamp and punch apparatus.

FIG. 8 shows a drive mechanism for transporting sheets, and for driving the stamping mechanism 33, and the punching mechanism 34.

The driving mechanism includes a drive motor 80 for transporting sheets, and a stamp and punch motor 81. Rotation output of the drive motor 80 is transferred to the transport rollers 42 through gears 82, 83 and 84. Rotation output of the stamp and punch motor 81 is transferred to a rotation axle 88 to which the eccentric wheel 76 is fixed, through gears 85, 86 and 87 and a clutch 79. In addition, the rotation output of the stamp and punch motor 81 is transferred to middle drive axles 77 and 78 through a pulley 89, a belt 90, and pulleys 91 and 92. Rotation force transferred to the middle drive axle 77 is transferred to the guide rollers 36 through gears 94 and 95 and a clutch 104, and is further transferred to an axle 63 to which the cam 61 is fixed, through gears 94, 96 and 97 and the clutch 98, and further through gears 99 and 100. Rotation force of the middle drive axle 78 is transferred to discharge rollers 37 through gears 101 and 102, and a clutch 103. The above motors, pulleys and gears are fixed to the frame 48 of the stamp and punch apparatus 21.

Control unit

Figure 9:
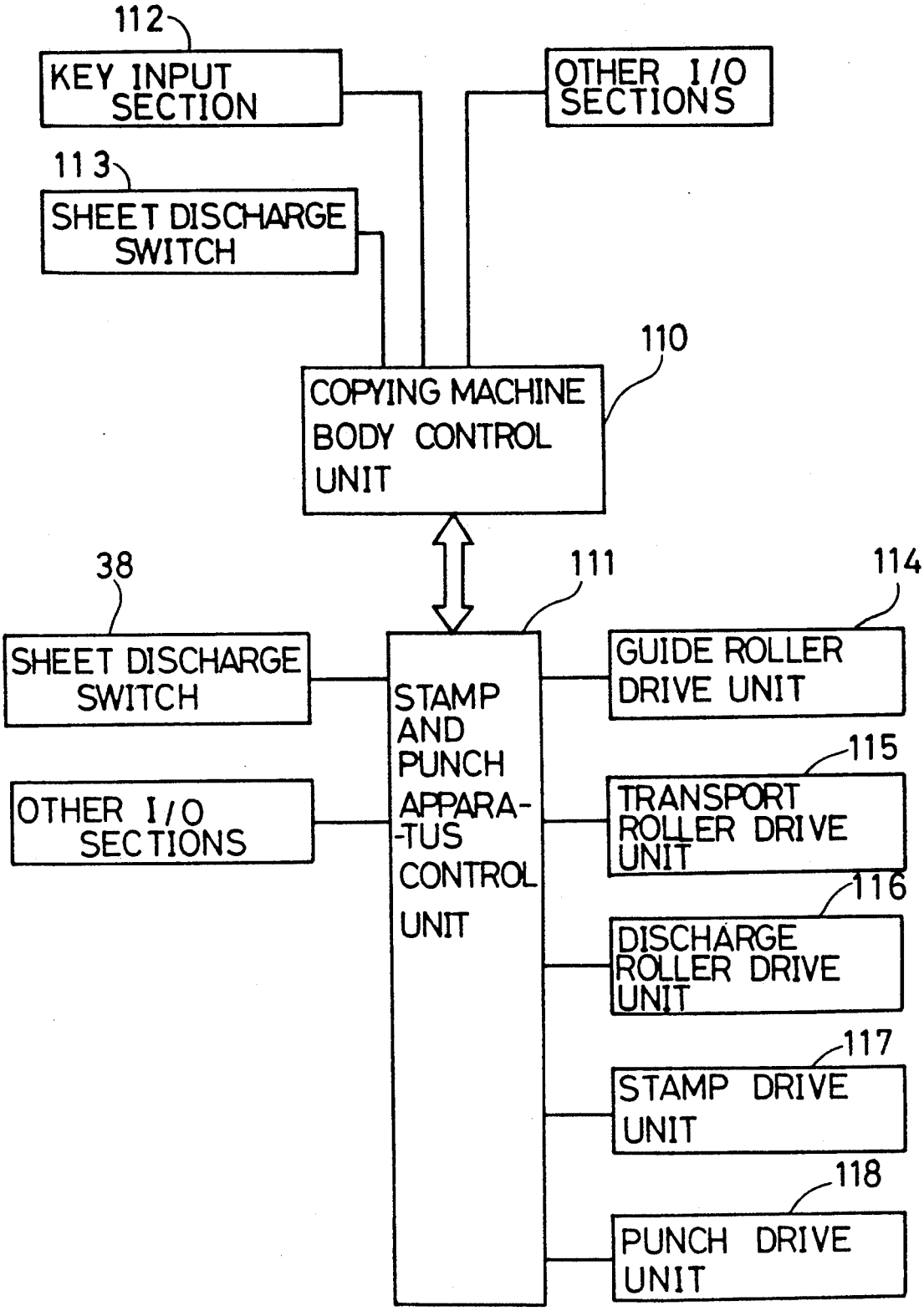
FIG. 9 is a block diagram of apparatus control means.

The copying machine body 1 and the stamp and punch apparatus 21 have respective control units 110 and 111, shown in FIG. 9. Each of the control units 110 and 111 comprises a microcomputer including a CPU, a ROM, a RAM and other elements. Connected to the control unit 110 of the copying machine body 1 are a key input section 112 disposed on the upper surface of the copying machine body 1, a sheet discharge switch 113 disposed on the forward side of the paper-stream discharge rollers 19, and other input/output sections. The control unit 111 of the stamp and punch apparatus 21 is connected to the control unit 110 of the copying machine body 1. Connected to the control unit 111 are the sheet discharge switch 38 shown in FIG. 2, a guide roller drive unit 114, a transport roller drive unit 115, a discharge roller drive unit 116, a stamp drive unit 117, and a punch drive unit 118. Each of the drive units 114 to 118 includes the drive motor 80, the stamp and punch motor 81, clutches, and other elements.

Mounting Operation and Stamp Surface Changing Operation of Stamp Unit

Figure 10:
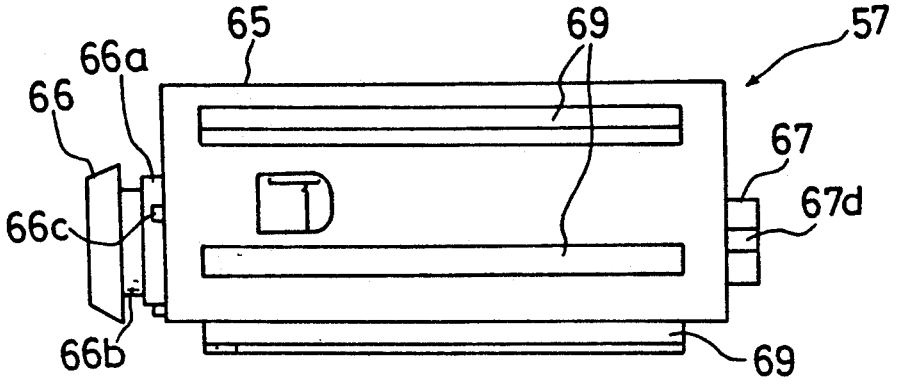
FIG. 10 is a side view of the stamp holder.
Figure 11:
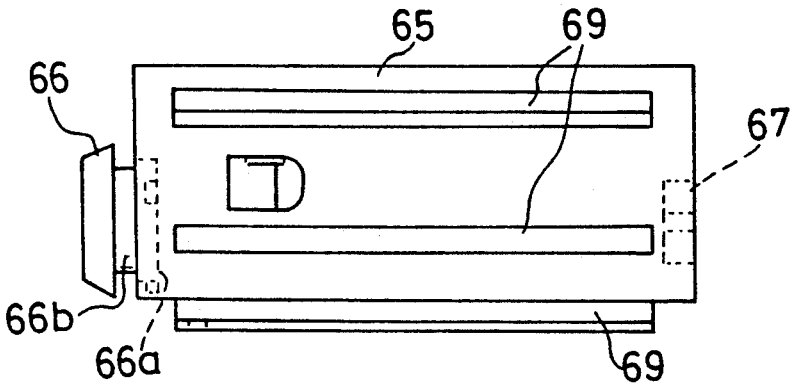
FIG. 11 is a side view for explaining the mounting operation of the stamp holder.

According to the embodiment of the present invention, the stamper mount 57 (stamp unit) shown in FIG. 10 is mounted to the supporting frame 46 of the stamping mechanism 33. In this case, since the stamp supporting frame 46 has a plurality of stamp unit retainers 56 in the sheet width direction, one stamper mount 57 can be mounted at a certain position thereof, or a plurality of stamper mounts 57 can be also mounted at a plurality of positions.

Figure 12:
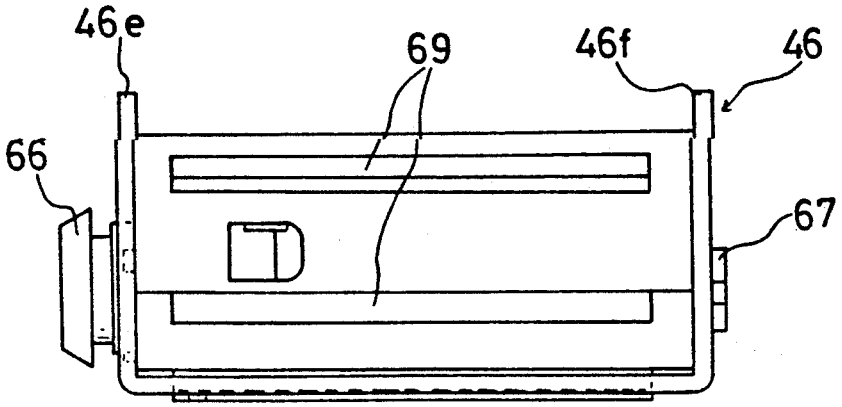
FIG. 12 is a side view showing a state in which the stamp holder is mounted.

When a stamper mount 57 is mounted to the stamp supporting frame 46, the first and second engagers 66 and 67 are pushed into the body 65 of the mount 57 from the state shown in FIG. 10. More specifically, the large-diameter segment 66*a* of the first engager 66 is inserted into the body 65, while the small-diameter segment 66*b* thereof remains outside the body 65, and the whole of the second engager 67 is inserted into the body 65. In this state, the stamper mount 57 is set in the receptacles 70 and 71 of the frame 46. More specifically, since the large-diameter segment 66*a* of the first engager 66 is within the body 65 and the small-diameter segment 66*b* thereof extends through the frame 46, and the whole of the second engager 67 is within the body 65, engagers are smoothly inserted into the receptacles 70 and 71. When the stoppers 66 and 67 are released from being thus pushed in, they are forced out by means of the spring 68. Then, the large-diameter segment 66*a* and the nub 66*c* of the first engager 66 become engaged with the receptacle 70 and the cutout 70*a*, respectively. Meanwhile, the small-diameter segment 67*c* and the nub 67*d* of the second engager 67 become engaged with the receptacle 71 and the cutout 71*a*, respectively. The stamper mount 57 is thus mounted into the stamp supporting frame 46, in the state as shown in FIG. 12.

Although the stamper 58 is not shown in FIGS. 5 to 7 and FIGS. 10 to 12, one or more stampers 58 may be mounted using the claws 69 formed on each side of the holder. While the above mounting operation is performed, the pivotal frames 45*a* and 45*b* are opened such that the stamp supporting frame 46 is brought into a state opposite that shown in FIG. 2, that is, the stamp unit retainer 56 of the stamper mount 57 is positioned toward the exterior.

When the stamp surface is to be changed, the pivotal frames 45*a* and 45*b* are opened in the same manner as above. Then, the first engager 66 is pushed into the holder body 65 and its small-diameter segment 66*a* is positioned so as to be engaged on the stamp supporting frame 46. In this state, the body 65 can rotate and a desired stamp can be moved into the stamping position. When the desired stamp is brought into the stamping position opposite the sheet-retaining surface, the first engager 66 is released from being pushed in, such that the first engager 66 presses out and its nubs 66*c* become engaged with the cutout 70*a*, whereby it is held against rotation.

As described above, since the plurality of stamp unit retainers 56 are arranged in the sheet width direction in this embodiment of the present invention, it is possible to change the stamping position in the sheet width direction. In addition, several kinds of stamps can operate at the same time by accordingly mounting stamper mounts 57 to each stamp unit retainer 56.

Furthermore, three stampers 58 can be mounted to one stamper mount 57, so that stamps can be changed even at the same stamp position.

Still further, mounting/dismounting of the stamp unit 55 and changing of the stamps can be effected through a simple process.

Operation Control

Operation therein will be described in reference to the process control flowcharts.

Figure 13:
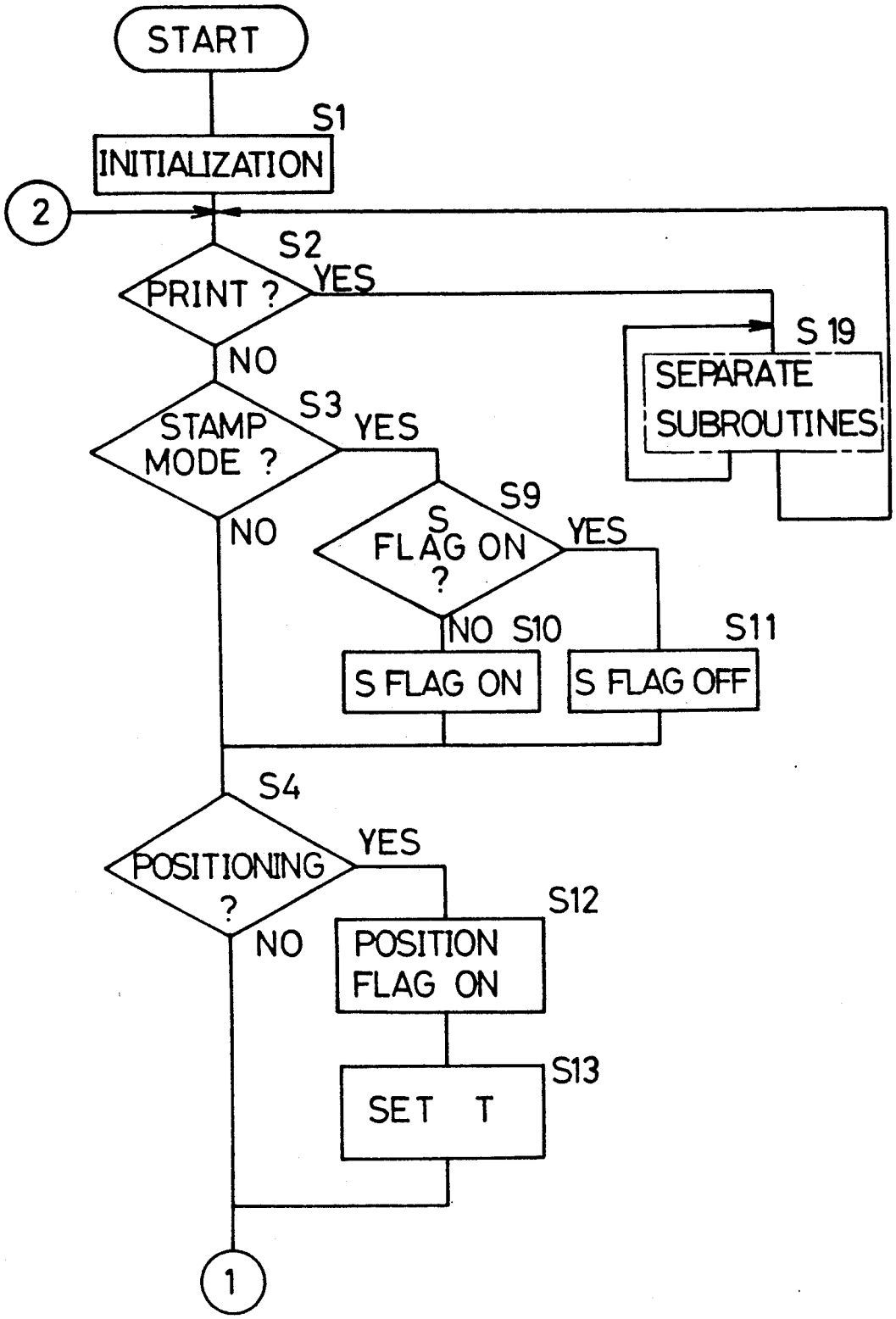
FIG. 13 is a copying machine body control process flowchart.
Figure 14:
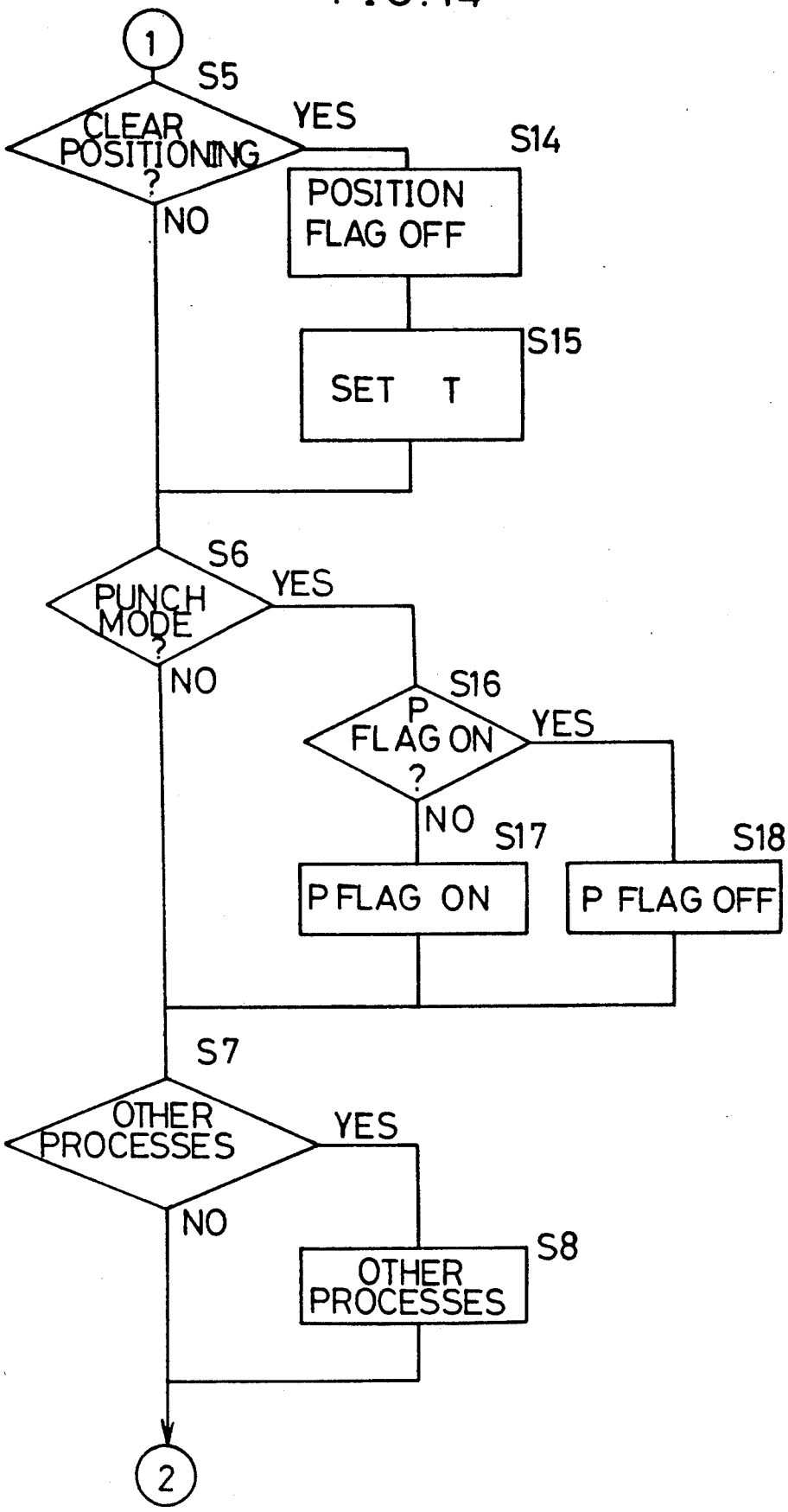
FIG. 14 is a copying machine body control process flowchart.
Figure 15:
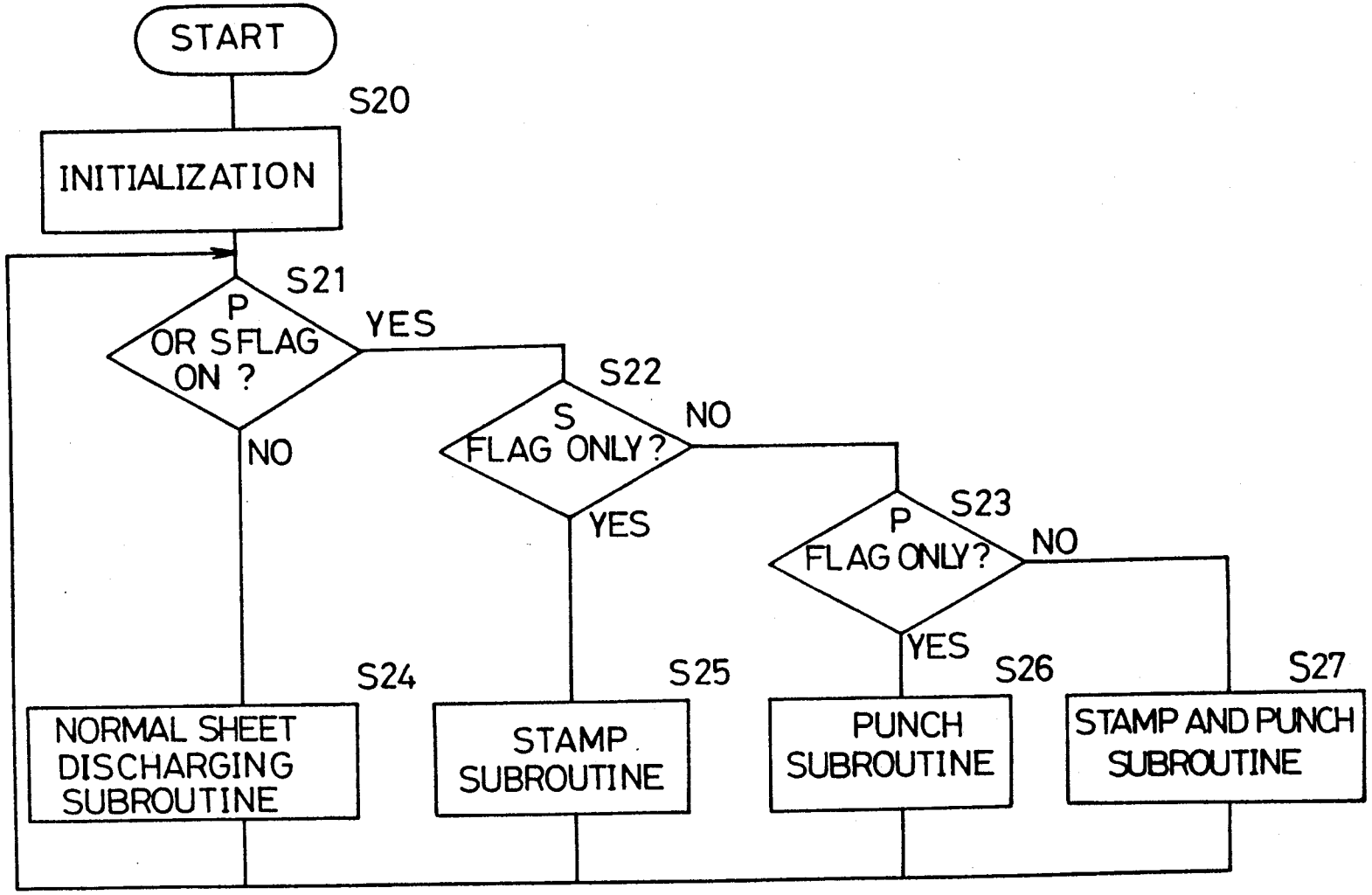
FIG. 15 is a flowchart of the stamp and punch apparatus control process.

Referring to FIG. 13, when a main switch (not shown) is turned ON, initialization is carried out, in which, for example, copy quantity is set to one and the fixing unit is heated at step S1. During initialization, a stamp flag, a position flag and punch flag, which will be described later, are set to their OFF states.

Then, it is determined at step S2 whether the print key has been pressed, at step S3 whether the stamp mode key has been pressed, at step S4 whether a key for specifying the stamp position has been pressed, at step S5 whether the position clear key for clearing a stamp position has been pressed, at step S6 whether the punch mode key has been pressed, and at step S7 whether or not other process keys have been pressed. The determinations from step S2 to step S7 are repeated until any one of the keys is pressed. When any key other than the print key, the stamp mode key, the position key, the position clear key and the punch mode key is pressed, the program proceeds from step S7 to step S8. At step S8, a process corresponding to the pressed key is performed and then the program returns to step S2.

When the stamp mode key is pressed, the program proceeds from step S3 to step S9. It is determined at step S9 whether the stamp flag (S flag) is ON or not. If the stamp flag is OFF, the program proceeds to step S10 to turn the stamp flag ON. Alternatively, if the stamp flag is ON, the program proceeds to step S11 to turn the stamp flag OFF. Thus, the stamp flag is switched between the ON and OFF states every time the stamp mode key is pressed.

When the key for specifying the stamp position is pressed, the program proceeds from step S4 to step S12. The position flag is turned ON at step S12. Then, a counter T of a timer for setting the stamp position is set according to the specified position at step S13 and the information thus obtained is input to the control unit 111 of the stamp and punch apparatus 21.

When the position clear key is pressed, the program proceeds from step S5 to step S14. The position flag is turned OFF at step S14. Then, at step S15, a counter T of a timer for stamping is set, whereby stamping is performed at a predetermined position.

When the punch mode key is pressed, the program proceeds from step S6 to step S16. It is determined at step S16 whether the punch flag (P flag) is ON or not. If the punch flag is OFF, the program proceeds to step S17 to turn the punch flag ON. Alternatively, if it is ON, the program proceeds to step S18 to turn the punch flag OFF. Thus, likewise with the stamp mode key, the punch flag is switched between the ON and OFF states every time the punch mode key is pressed.

When the print key is pressed by the operator, the program proceeds from step S2 to step S19, in which various kinds of subroutines are performed. The subroutines at step S19 include, for example a subroutine for controlling sheet feeding, and a subroutine for forming an image.

The stamp and punch apparatus 21 performs processes as accordingly shown in the process control flowcharts of FIGS. 15 to 20.

More specifically, when the main switch on the copying machine body 1 is turned ON, initialization is carried out at step S20, in which the cam 61 of the stamping mechanism 33 and the eccentric cam 76 of the punching mechanism 34 are moved to initial positions.

Then, it is determined whether both the punch and stamp flags are ON at step S21, whether only the stamp flag is ON at step S22, and whether only the punch flag is ON at step S23. If both of the punch flag and the stamp flag are OFF, the program proceeds from step S21 to step S24. At step S24, a normal sheet-discharging subroutine is carried out. If only the stamp flag is ON, the program proceeds from step S22 to step S25. At step S25, a stamp subroutine is carried out. If only the punch flag is ON, the program proceeds from step S23 to step S26. At step S26, a punch subroutine is carried out. When both the stamp flag and the punch flag are ON, the program proceeds to S27 through steps S21, S22 and S23. At step S27, a stamp and punch subroutine is carried out.

Normal Sheet-Discharging Mode

When the normal sheet-discharging mode has been selected, the normal sheet-discharging subroutine at step S24 is carried out.

Figure 16:
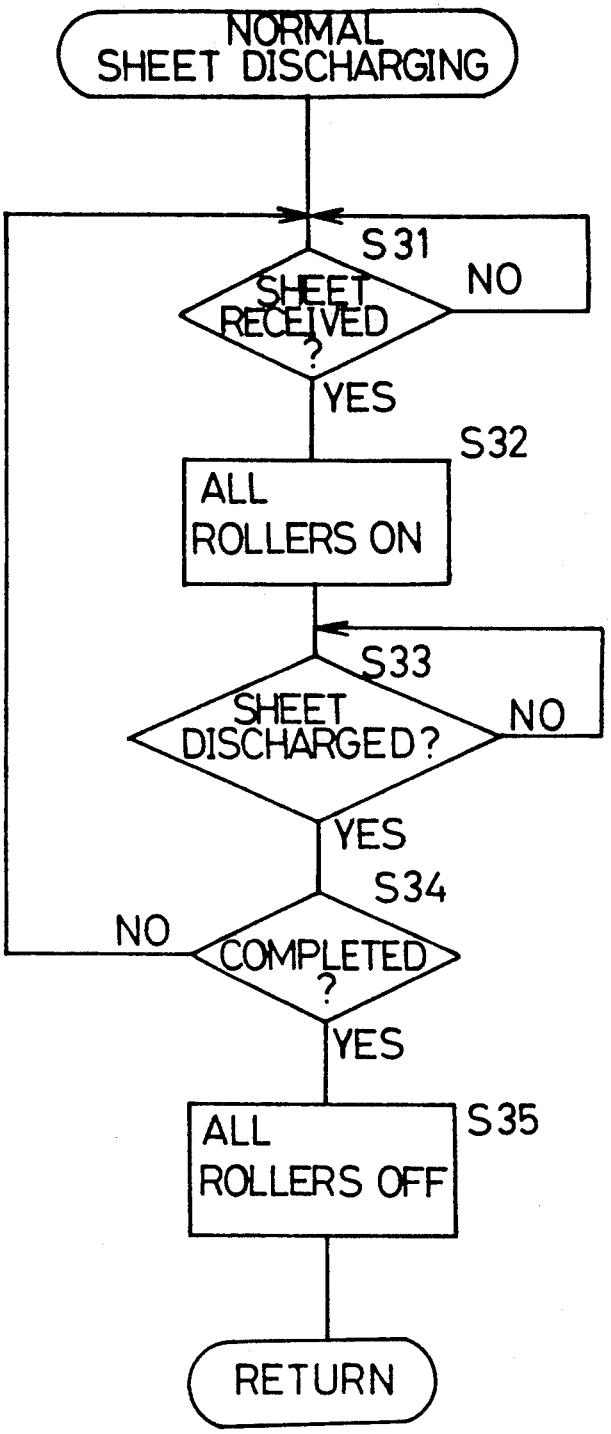
FIG. 16 is a flowchart of a normal sheet-discharging subroutine control process.

In this subroutine, as shown in FIG. 16, it is determined at step S31 whether a sheet is discharged from the copying machine body 1 or not. That is, it is determined whether a signal, indicating that the sheet discharge switch 113 of the copying machine body 1 has been switched ON by the sheet , is output to the control unit 111 of the stamp and punch apparatus 21.

When the signal is output from the copying machine body 1, the program proceeds from step S31 to step S32. At step S32, the guide rollers 36, the transport rollers 42 and the discharge rollers 37 are driven. So as to transport the sheet in the forward direction, each of the rollers 36, 37 and 42 is driven by activating the drive motor 80 and the stamp and punch motor 81, and by coupling the respective clutches 104 and 103.

Then, it is determined at step S33 whether or not the sheet has been discharged from the stamp and punch apparatus 21. That is, when the sheet is discharged from the copying machine body 1, it is guided to the first transport route 40 through the guide path 35 and the guide rollers 36. When the sheet passes through the transport rollers 42, the sheet discharge switch 38 is turned ON and then the sheet is discharged to the sorter 7 by the discharge rollers 37. When the trailing edge of the sheet then passes through the sheet discharge switch 38, the switch is turned OFF. When the sheet discharge switch is turned OFF, the program proceeds from step S33 to step S34.

It is determined at step S34 whether the entire quantity of sheets has been passed through the stamp and punch apparatus 21. This determination is made by a signal output from the control unit 110 of the copying machine body 1. If it is not, the program proceeds from step S34 to step S31 and the processes from step 31 to step 34 are repeated. Meanwhile, if all the sheets have passed through the apparatus 21, the program proceeds from step S34 to step S35. At step S35, the drive motor 80 and stamp and punch motor 81 are switched OFF, stopping the rollers, and then the program returns to the main routine.

Stamp Mode

Wherein the stamp mode is designated, the stamp subroutine at step S25 is carried out.

Figure 17:
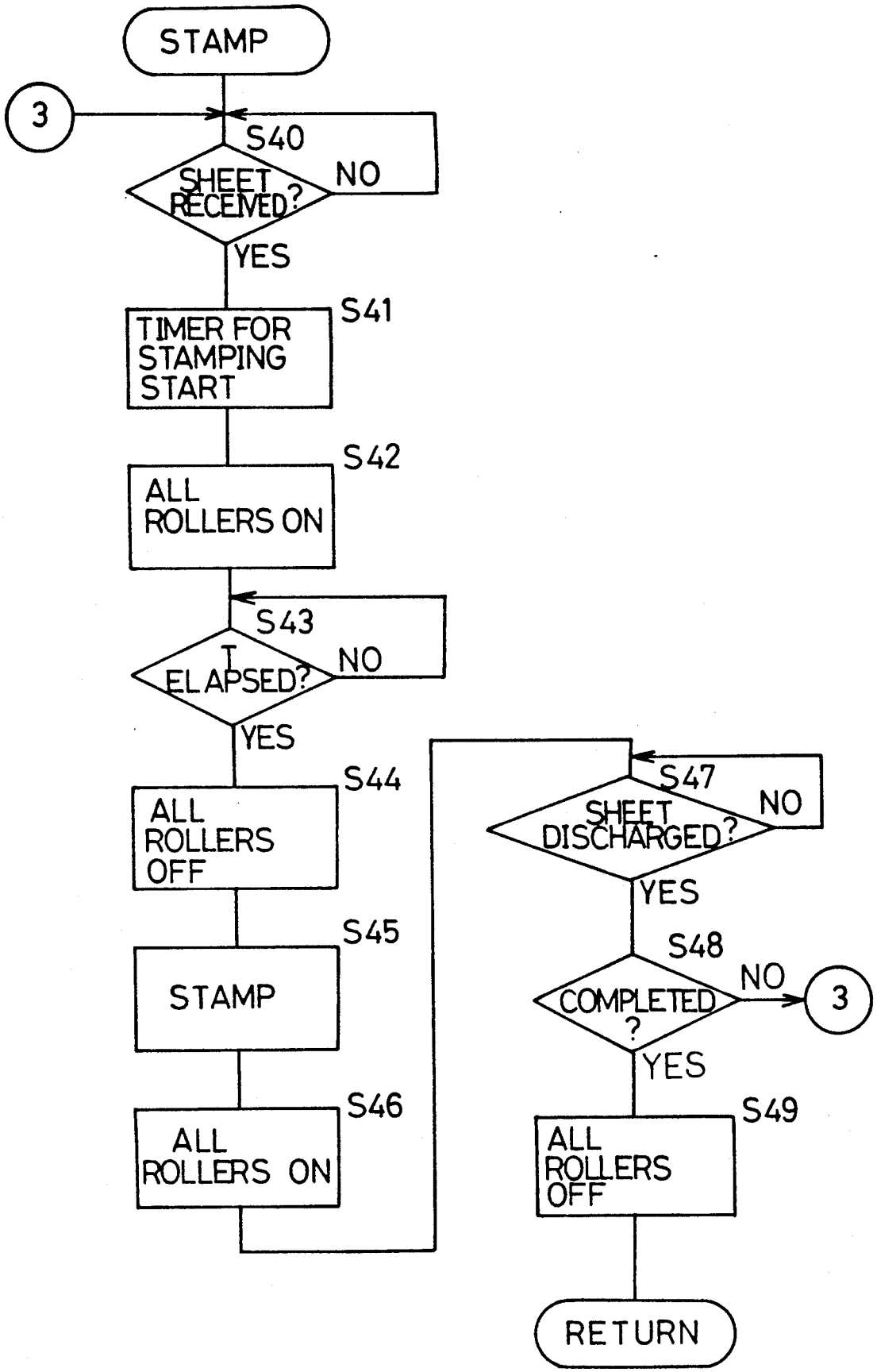
FIG. 17 is a flowchart of a stamp subroutine control process.

In this routine, as shown in FIG. 17, it is determined at step S40 by the sheet discharge signal whether a sheet has been discharged from the copying machine body 1. If so, the program proceeds from step S40 to step S41. A stamping timer starts at step S41. Then, at step S42, the drive motor 80 and the stamp and punch motor 81 are switched ON to rotate the rollers 36, 42 and 37. The sheet is thus guided from the guide rollers 36 to the first transport route 40 and then transported from the transport rollers 42 to the discharge rollers 37. Herein, if the sheet is of large size, the leading edge of the sheet passes through the discharge rollers 37, and then is fed into the sorter 7.

It is determined at step S43 whether the stamping timer indicates a set time or not. If it does, the program proceeds to step S44. At step S44, the drive motor 80 and stamp and punch motor 81 are switched OFF, stopping rotation of each of the rollers 36, 42 and 37, whereby sheet transport is halted. At the same time, the rollers in the sorter 7 are also stopped. At step S45, the stamp and punch motor 81 is switched ON coupling the clutch 98, whereby the cam 61 rotates once through the gears 99 and 100. When the cam 61 starts to rotate, first, the catch 61*a* of the cam 61 abuts on the stop 60*a* of the lifting unit 60, and then the stamp unit 55 is driven down through the action of the lifting unit 60, the pin 51 and the stamp supporting frame 46. Thus, the stamper 58 is pressed onto the sheet which is stopped in the first transport route 40, performing a stamping operation. Then, while the cam 61 rotates further, the catch 61*a* comes off the stop 60*a* of the lifting unit 60 such that the stamp supporting frame 46 is lifted by the return spring 52, whereby the stamp unit 55 is also returned to its initial position, as shown in FIG. 2.

After the stamping process is completed, the program proceeds to step S46. At step S46, the rollers 36, 42 and 37 are rotated. At the same time, the rollers in the sorter are also rotated. Then, it is determined at step S47 whether the sheet is discharged or not. That determination is made by detecting that the sheet discharge switch 38 is switched OFF, likewise as described above. When it is determined that the sheet has been discharged, the program proceeds to step S48. It is determined at step S48 whether the set number of sheets have passed through or not. If not, the program returns to step S40. Then, the processes from step S40 to step S48 are repeated. If the given number of sheets has passed through, the program proceeds from step S48 to step S49. At step S49, the drive motor 80 and the stamp and punch motor 81 are switched OFF to stop all of the rollers, and then the program returns to the main routine.

Punch mode

Wherein the punch mode is specified, the punch subroutine at step S26 is carried out.

Figure 18:
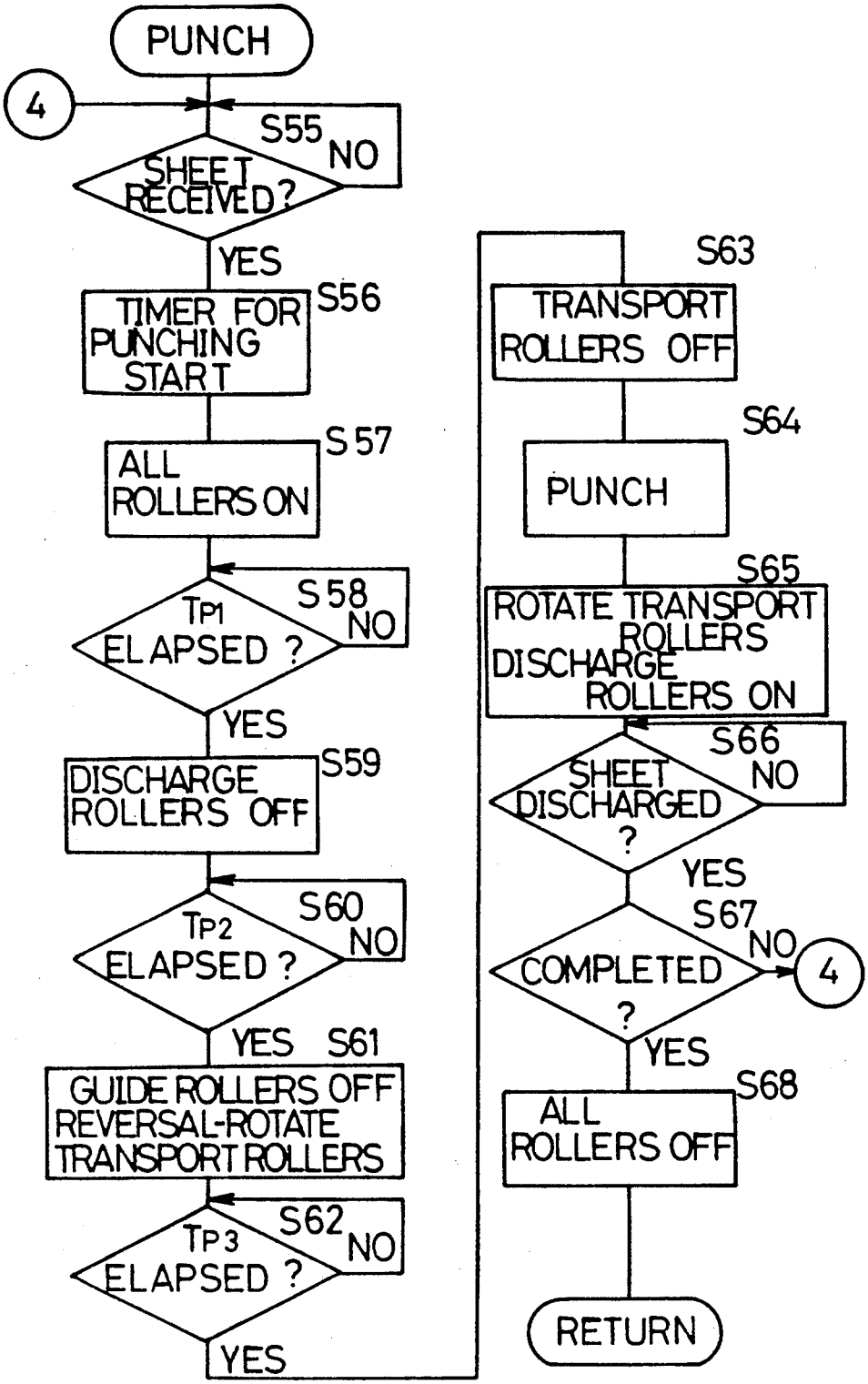
FIG. 18 is a flowchart of a punch subroutine control process.

In the punch subroutine, as shown in FIG. 18, it is determined at step S55 whether a sheet has been discharged from the copying machine body 1. If so, the program proceeds from step S55 to step S56. At step S56, the punching timer is started. Then, at step S57, the rollers 36, 42 and 37 are rotated, whereby the sheet is guided from the guide rollers 36 to the first transport path 40, as described above, and transported to the sorter 7 by means of transport rollers 42 and the discharge rollers 37.

Figure 21:
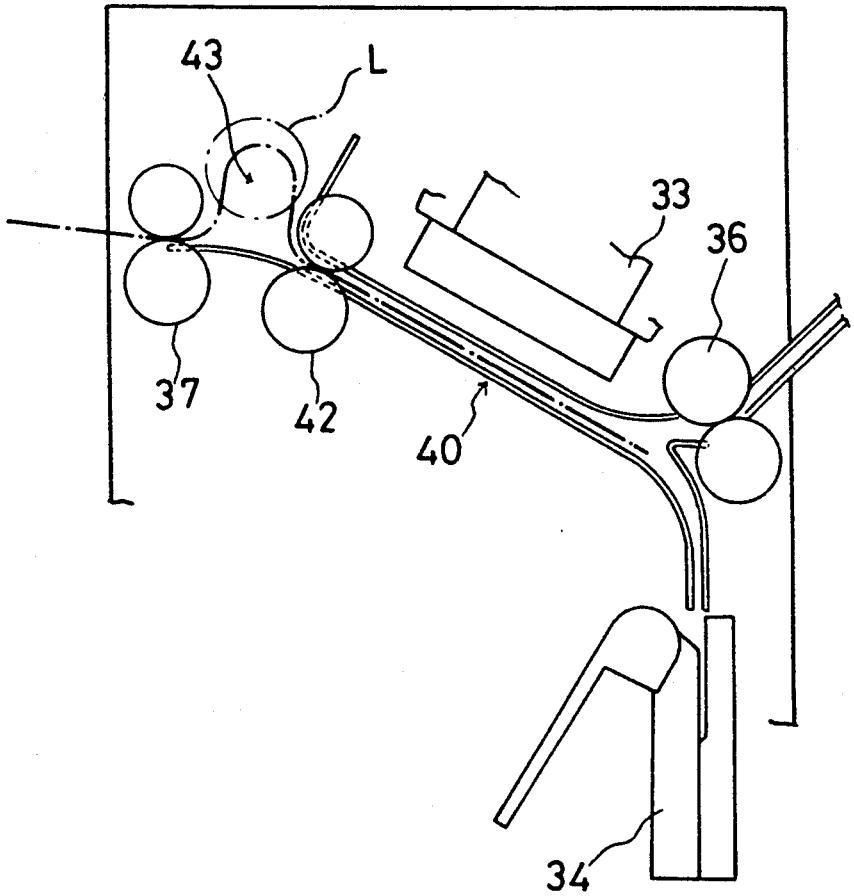
FIG. 21 is a view illustrating a sheet in transport.

Then, it is determined at step S58 whether time Tp1 has elapsed in the punching timer. After the elapse of time Tp1, the program proceeds to step S59. At step S59, the clutch 103 is switched OFF, stopping only the discharge rollers 37, and the punching timer is reset and started again. At the same time the discharge rollers 37 are stopped, the rollers in the sorter are also stopped. The time Tp1 is set corresponding to the sheet size. More specifically, it is set so that the discharge rollers 37 may be stopped when the length from the trailing edge in the path 30 of the sheet being transported in the first transport route 40 to the junction (or divergence point) of the first transport route 40 and the second transport route 42 becomes equal to a transport length of the second transport route 41. The above transport length of the second transport route 41 is the distance from the junction of the transporting paths 40 and 41 to its end at the sheet entrance portion of the punching mechanism 34, as shown by P in FIG. 2. Thus, the discharge rollers 37 are stopped when the length from the divergence point of the second transport route 41 to the trailing edge of the sheet becomes a constant length P, while the guide rollers 36 are still rotated, whereby the sheet is carried into a loop of length P in the loop forming space 43 provided on the right side of the discharge rollers 37. A loop is thus formed as shown in FIG. 21. When the sheet size is large, the leading edge of the sheet gets fed into the sorter 7 and nipped by rollers therein. As a result, since there is provided the loop forming space 43 where the loop corresponding to the transporting distance of the second transport route 41 is formed, the punching operation can be performed through transport control within the stamp and punch apparatus 21 only, such that only ON/OFF control of the transport rollers is necessary in the sorter 7.

After the elapse of time Tp1, the program proceeds to step S60. It is determined at step S60 whether time Tp2 has elapsed since the discharge rollers 37 were stopped. If so, the program proceeds to step S61. The time Tp2 is a timing of the passing of the trailing edge of the sheet through the guide rollers 36 and further just through the junction (divergence point) of the second transport route 41. At step S61, the guide rollers 36 are stopped, and the transport rollers 42 are rotated in the direction reverse to their previous direction, whereby the sheet is transported to the right in FIG. 21. Since the end of the first transport route 40 opens into the second transport route 41, the sheet is reversely transported from the first transport route 40 to the second transport route 41. At the same time, the punching timer is reset and started again at step S61. Then, it is determined at step S62 whether time Tp3 has elapsed in punching timer. If so, the program proceeds to step S63. At step S63, the transport rollers 42 are halted, and thus the trailing edge of the sheet is stopped, wherein it is inserted in the punching mechanism 34.

Then, at step S64, the eccentric wheel 76 is rotated once through coupling of the clutch 79 attached on the end of the rotation axle 88. While the eccentric wheel 76 is rotated once, the lever 75 of the punching mechanism 34 is pressed, perforating the trailing edge of the sheet.

When the punching operation is completed at step S64, the transport rollers 42 are rotated so as to transport the sheet forward, and the discharge rollers 37 are also rotated through coupling of the clutch 103 at step S65, whereby the sheet in both the first and second transporting paths 40 and 41 is discharged to the sorter 7. Then, it is determined at step S66 whether the sheet has been discharged or not. If it has, the program proceeds to step S67. It is determined at step S67 whether the set number of sheets have all passed or not. If not, the program returns to step S55, and the processes from step S55 to step S67 are repeated. After the set number of sheets have passed, the program proceeds from step S67 to step S68. At step S68, the rollers 36, 42 and 37 are stopped and the program returns to the main routine.

Stamp and punch mode

When both stamp mode and punch mode are designated, the stamp and punch subroutine at step S27 is carried out.

Figure 19:
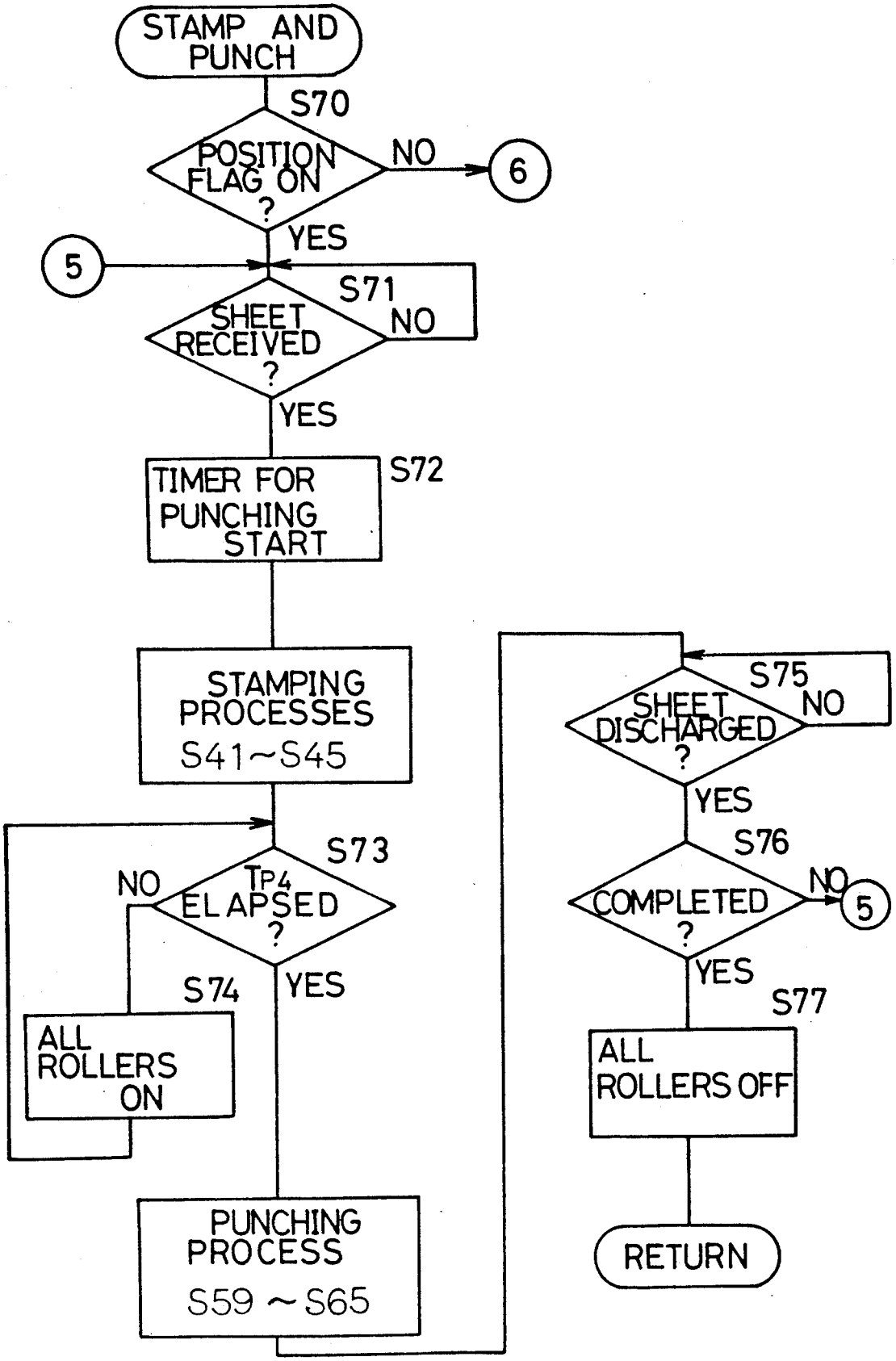
FIG. 19 is a flowchart of a stamp and punch subroutine control process.

In this subroutine, as shown in FIG. 19, it is determined at step S70 whether the position flag is ON. If it is, since the longitudinal stamp position has been designated by the operator, the stamping operation and subsequently the punching operation are performed. That is, the program proceeds from step S70 to step S71.

It is determined at step S71 whether a sheet has been discharged from the copying machine body 1 or not. If so, the program proceeds to step S72. At step S72, the punching timer is started. Then, the processes from step S41 to step S45 in FIG. 17 are carried out, to perform a stamping operation onto the sheet. Then, it is determined at step S73 whether time Tp4 has elapsed in the punching timer. The punching timer does not count while the guide rollers 36 are OFF during the stamping operation. More specifically, at step S73, the transported distance of the sheet is determined through determining whether the trailing edge of the sheet has traveled beyond the junction of the second transport route 41 to the left of the guide rollers 36. For example, in a case where the stamp position is specified at the leading edge of the sheet, the sheet is stopped as its trailing edge is nipped by the guide rollers 36, and then the stamping operation is carried out. Therefore, in this case, NO is determined at step S73, and then the program proceeds to step S74. At step S74, the guide rollers 36 and the transport rollers 42 are rotated until the time Tp4 has elapsed.

If YES is determined at step S73, the punching operation is performed. The punching operation is performed through the same processes of steps S59 to S65 as shown in FIG. 18. After the punching operation, the program proceeds to step S75. It is determined at step S75 whether the sheet has been discharged or not. If it has, the program proceeds to step S76. It is determined at step S76 whether the set quantity of sheets has passed through or not. If not, the program returns to step S71, and the foregoing processes are repeated. If so, the program proceeds from step S76 to step S77, in which all of the rollers 36, 42 and the 37 are stopped. Then, the program returns to the main routine.

Figure 20:
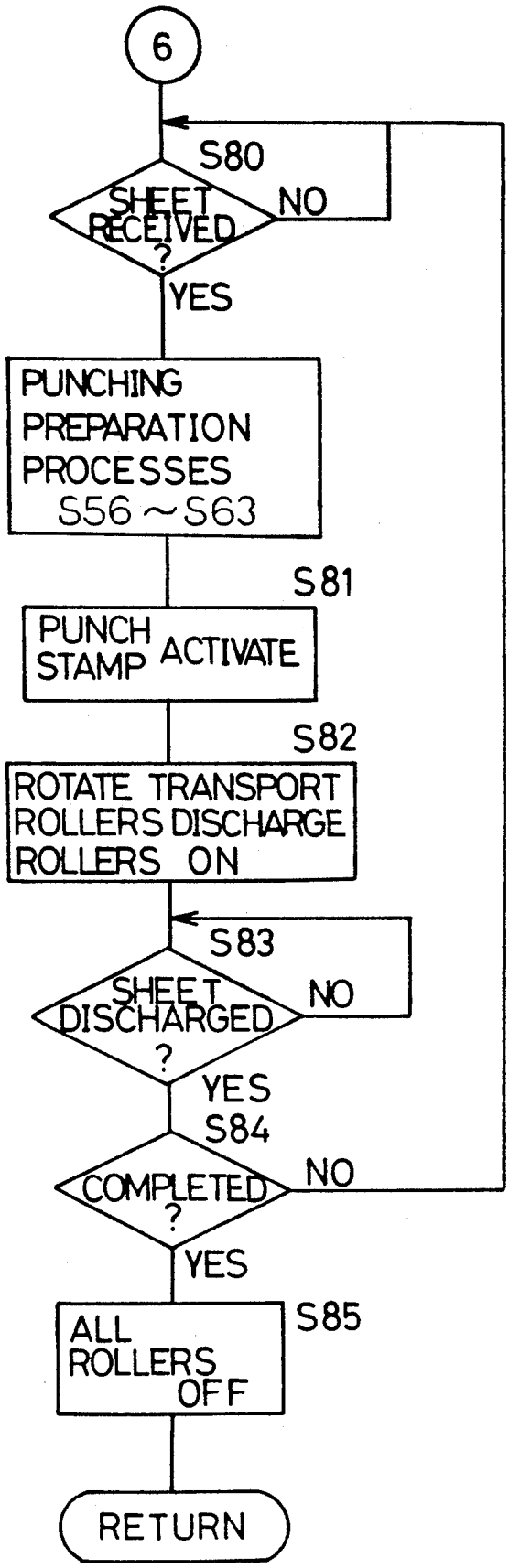
FIG. 20 is a flowchart of the stamp and punch subroutine control process.

Meanwhile, if the position flag is not ON, the program proceeds to step S80 of FIG. 20. It is determined at step S80 whether the sheets has been discharged from the copying machine body 1. If it has, the punching preparation procedure is carried out. The punching preparation procedure is the same as that of steps S56 to step S63 of FIG. 18. When the punching preparation procedure is completed, the trailing edge of the sheet is positioned at a predetermined position of the punching mechanism and the leading edge of the sheet is positioned in the first transport path 40. In this state, the program proceeds to step S81, in which the punching and stamping operations are simultaneously carried out. Then, the program proceeds to step S82, in which the transport rollers 42 are rotated so as to transport the sheet forward, and the discharge rollers 37 are also rotated, whereby the sheet on which the stamping and punching processes have been performed is discharged to the sorter 7.

It is determined at step S83 whether the sheet has been discharged or not. If it has, the program proceeds to step S84. It is determined at step S84 whether the set number of sheets has passed through or not. If not, the program returns to step S80, and the above processes are repeated. If so, the program proceeds to step S85, in which all of the rollers 36, 42 and 37 are stopped and the program returns to the main routine.

According to the above embodiment of the present invention, since the stamping mechanism 33 is disposed above the first transport route 40 and the punching mechanism 34 is disposed at the end of the second transport route 41 diverging downward from the first transport route 40, the dimension of the stamp and punch apparatus 21 in the sheet-transporting direction is minimized.

In addition process control is simplified, since when the punching operation is carried out, the discharge rollers 37 are halted and the loop of length equal to the transport distance P of the second transport path 41 is formed in the portion of the sheet in the loop forming space 43, only ON/OFF control of the rollers is necessary in the sorter 7.

Furthermore, in the apparatus, timing between the stamping and the punching operations is controlled by whether the longitudinal stamp position has been specified or not. More specifically, wherein the stamping position is not specified, the stamping operation and the punching operation can be simultaneously carried out, whereby the processing time is shortened. Wherein neither of these operations is performed, the sheet can be discharged in short time through the transport path of minimized length in the transport direction.

Still further, the apparatus according to the above embodiment of the present invention can be easily installed onto a copying machine body 1 having no stamping and punching function, such that the stamping and punching functions can be readily added to the conventional copying machine.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A sheet processing apparatus for processing sheets discharged from an image forming unit of an image forming apparatus, comprising:

a sheet supplier;

a sheet discharger;

a first transport route connecting said sheet supplier with said sheet discharger;

first processing means disposed facing a sheet in said first transport route, for performing a first process on the sheet;

a second transport route diverging at a divergence point from said first transport route in a direction therebelow;

second processing means facing opposite said sheet in said second transport route, for performing a second process on said sheet; and transport means for transporting sheets along said first and second transport routes.

2. The sheet processing apparatus according to claim 1, further comprising:

process designating means for designating a process to be performed on a sheet;

transport control means, for controlling said transport means, so that in an instance in which the second process is designated by said process designated means, that in transporting a sheet from said sheet supplier to said sheet discharger, whereupon the trailing edge of said sheet passes the divergence point of said first transport route, said sheet is transported in a reverse direction into said second transport route, until said trailing edge of said sheet is opposite said second processing means.

3. The sheet processing apparatus according to claim 2, further comprising transport control and simultaneous activating means, for so controlling said transport means, in an instance in which both the first and second processes are designated by said process designating means, that one end of said sheet in transport is opposite said first processing means, and its corresponding other end is opposite said second processing means; wherein said transport control and simultaneous activating means operates both said first and second processing means simultaneously.

4. The sheet processing apparatus according to claim 3, wherein said first processing means is a stamping means for performing a stamping process onto a sheet; and said second processing means is a punching means for forming punch-holes in a sheet.

5. The sheet processing apparatus according to claim 2, further comprising means for controlling process timing of said first and second processing means according to a status of process control as designated by said process designating means.

6. The sheet processing apparatus according to claim 5, wherein said process designating means includes means for selecting a specific sheet-processing position; and said process timing control means directs said first and second processes to perform at different times when a specific sheet-processing position has been selected by said sheet-processing position selecting means, and directs said first and second processes to perform simultaneously when said sheet-processing position has not been selected.

7. The sheet processing apparatus according to claim 6, wherein said first processing means is a stamping means of performing a stamping process on a sheet; and said second processing means is a punching means for forming punch-holes in a sheet.

8. The sheet processing apparatus according to claim 2, further comprising a sheet-curling means, effective wherein the second process is designated by said process designating means, for forming a loop, in a portion of a sheet in transport along said first transport route, of length corresponding to a transport distance from the divergence point of said first transport route to the trailing edge of a sheet when located in said second transport route during performance of the process of said second processing means, such that the trailing edge of the sheet is transported forward of the divergence point of said first transport route.

9. The sheet processing apparatus according to claim 8, wherein said first processing means is a stamping means for performing the stamping process onto a sheet; and said second processing means is a punching means for forming punch-holes in a sheet.

10. The sheet processing apparatus according to claim 9, wherein said image forming apparatus includes a copying machine body and a sorter for sorting copy-processed sheets; and said sheet supplier supplies a sheet as discharged from said copying machine body, and said sheet discharger discharges said sheet into said sorter.

11. A modular sheet processing apparatus which can be mounted on an image forming apparatus for processing sheets discharged from an image forming apparatus, comprising:

a sheet supplier;

a sheet discharger;

a transport path provided between said sheet supplier and said sheet discharger;

means for transporting said sheets along said transport path in a sheet-transport direction;

stamping means including a stamp unit oriented so as to face said transport path;

a stamp-unit supporting frame; and a stamp operating mechanism for operating said stamp unit, said stamp-unit supporting frame having a plurality of stamp unit retainers each capable of detachably supporting said stamp units through a stamper mount, and further having an inking stamper detachably mounted to said stamper mount, said stamping means being adapted to assume different operational positions in a direction intersecting said sheet-transport direction for stamping a sheet while said sheet is in transport along said transport, and said stamp-unit supporting frame being mounted so as to be movable toward and away from said transport path by a stamp operating mechanism which drives said stamp-unit supporting frame.

12. The sheet processing apparatus according to claim 11, wherein said stamper mount comprises a body retained to said stamp unit supporting frame by an engager and wherein said inking stamper is mounted on said body.

13. The sheet processing apparatus according to claim 12, wherein said body of said stamper mount is substantially triangular in configuration and has claws on each side for clasping said inking stamper; and said body is rotatable, such that selectively, each of said sides may in turn be opposed to said transport path.

14. The sheet processing apparatus according to claim 13, further comprising a coupling mechanism for prohibiting said body of said stamper mount from being rotated or allowing it to be further rotated.

15. The sheet processing apparatus according to claim 11, further comprising a hinged frame for supporting said stamp-unit supporting frame, said hinged frame being adjustable between a closed position, in which the stamp unit mounted in said stamp-unit supporting frame faces said transport path, and an opened position, in which said stamp unit is pivoted up and away from said closed position.

16. The sheet processing apparatus according to claim 15, wherein said stamp operating mechanism includes an urging member disposed between said hinged frame and said stamp-unit supporting frame, for impelling said stamp-unit supporting frame in a direction away from said transport path; and a driving mechanism for driving said stamp-unit supporting frame against the force of said urging member.

17. The sheet processing apparatus according to claim 11, wherein said stamp unit has a plurality of stamping surfaces which selectively can be positioned opposite a sheet being transported in said transport path.

18. The sheet processing apparatus according to claim 17, wherein said stamp unit is rotatably mounted on said supporting frame.

19. The sheet processing apparatus according to claim 18, further comprising a coupling mechanism for prohibiting said stamp unit from being rotated wherein, each of said plurality of stamping surfaces mounted in said stamp-unit supporting frame can be selectively positioned opposite a sheet.

20. The sheet processing apparatus according to claim 19, wherein said inking stamper can be held against any of the sides of said stamper mount by said holders.

21. The sheet processing apparatus according to claim 17, wherein said transport path includes a first transport route connecting said sheet supplier and said sheet discharger, and a second transport route diverging from said first transport route in a direction therebelow; said apparatus further including hole punching means disposed so as to be opposite a sheet in said second transport route.

22. The sheet processing apparatus according to claim 21, further comprising:

means for designating a process to be performed on a sheet; and transport control means, for controlling said transport means, so that in an instance in which a punching process is designated by said process designating means, that in transporting a sheet from said sheet supplier to said sheet discharger, whereupon the trailing edge of said sheet passes the divergence point of said first transport route, said sheet is transported in a reverse direction into said second transport route, until said trailing edge of said sheet is opposite said punching means.

23. The sheet processing apparatus according to claim 22, further comprising transport control and simultaneous activating means, for controlling said transport means, in an instance in which both the stamping process and the punching process are designated by said process designating means, such that one end of said sheet in transport is opposite said stamping means, and a corresponding other end is opposite said punching means; wherein said transport control and simultaneous activating means operates both said stamping and punching means simultaneously.

24. The sheet processing apparatus according to claim 22, further comprising a sheet-curling means, effective wherein the punching process is designated by said process designating means, for forming a loop, in a portion of a sheet in transport along said first transport route, of a length corresponding to a transport distance from the divergence point of said first transport route to the trailing edge of a sheet when located in said second transport route during a punching process of said punching means, such that the trailing edge of said sheet is transported forward of the divergence point of said first transport route.

25. The sheet processing apparatus according to claim 24, wherein said image forming apparatus includes a copying machine body and a sorter for sorting copy-processed sheets; and said sheet supplier supplies as sheet a discharged from said copying machine body, and said sheet discharger discharges said sheet into said sorter.

26. The sheet processing apparatus according to claim 11, wherein said transport path includes a first transport route connecting said sheet supplier and said sheet discharger, and a second transport route diverging from said first transport route a direction therebelow; said apparatus further including hole punching means disposed so as to be opposite a sheet in said second transport route.

27. The sheet processing apparatus according to claim 26, further comprising:

means for designating a process to be performed on a sheet; and transport control means, for controlling said transport means, so that in an instance in which a punching process is designated by said process designating means, that in transporting a sheet from said sheet supplier to said sheet discharger, whereupon the trailing edge of said sheet passes the divergence point of said first transport route, said sheet is transported in a reverse direction into said second transport route, until said trailing edge of said sheet is opposite said punching means.

28. The sheet processing apparatus according to claim 27, further comprising transport control and simultaneous activating means, for controlling said transport means, in an instance in which both the stamping process and the punching process are designated by said process designating means, such that one end of said sheet in transport is opposite said stamping means, and a corresponding other end is opposite said punching means; wherein said transport control and simultaneous activating means operates both said stamping and punching means simultaneously.

29. The sheet processing apparatus according to claim 27, further comprising means for controlling process timing of said stamping means and said punching means according to a status of process control as designated by said process designating means.

30. The sheet processing apparatus according to claim 29, wherein said process designating means includes means for selecting a specific sheet-stamping position; and said process timing control means directs said stamping process and punching process to perform at different times when a specific stamping position has been selected by said stamping position selecting means, and directs said stamping process and said punching process to perform simultaneously when said stamping position has not been selected.

31. The sheet processing apparatus according to claim 27, further comprising a sheet-curling means, effective wherein the punching process is designated by said process designating means, for forming a loop, in a portion of a sheet in transport along said first transport route, of a length corresponding to a transport distance from the divergence point of said first transport route to the trailing edge of a sheet when located in said second transport route during a punching process of said punching means, such that the trailing edge of the sheet is transportable toward said punching means from the divergence point of said first transport route.

32. The sheet processing apparatus according to claim 31, wherein said image forming apparatus includes a copying machine body and a sorter for sorting a copy-processed sheets; and said sheet supplier supplies a sheet as discharged from said copying machine body, and said sheet discharger discharges said sheet into said sorter.

33. A sheet processing apparatus for processing sheets discharged from an image forming apparatus, comprising:

a sheet supplier;

a sheet discharger;

a transport path provided between said sheet supplier and said sheet discharger;

means for transporting said sheets along said transport path;

stamping means including a stamp unit for performing a stamping process for a sheet, said stamping means having a plurality of stamping surfaces which can be selectively positioned to face a sheet in transport along said transport path;

said stamping means including, a stamp-unit supporting frame which extends in the direction intersecting said sheet-transport direction wherein said frame can be moved toward and withdrawn from said transport path, and a stamp operating mechanism for operating said stamp-unit supporting frame, and said stamp unit being rotatably mounted on said supporting frame;

said sheet processing apparatus including a coupling mechanism for prohibiting said stamp unit from being rotated wherein each of said plurality of stamping surfaces mounted on said stamp unit supporting frame can be selectively positioned opposite a sheet;

said stamp unit including a mounting body substantially triangular in configuration and having holders on each side wherein an inking stamper is held against each surface of said mounting body by said holders.

34. The sheet processing apparatus according to claim 33, wherein said transport path includes a first transport route connecting said sheet supplier and said sheet discharger, and a second transport route diverging from said first transport route in direction therebelow; said apparatus further including hole punching means disposed so as to be opposite a sheet in said second transport route.

35. The sheet processing apparatus according to claim 34, further comprising:

means for designating a process to be performed on a sheet; and transport control means, for controlling said transport means, so that in an instance in which a punching process is designated by said process designating means, that in transporting a sheet from said sheet supplier to said sheet discharger, whereupon the trailing edge of said sheet passes the divergence point of said first transport route, said sheet is transported in a reverse direction into said second transport route, until said trailing edge of said sheet is opposite said punching means.

36. The sheet processing apparatus according to claim 35, further comprising a sheet-curling means, effective wherein the punching process is designated by said process designating means, for forming a loop, in a portion of a sheet in transport along said first transport route, of a length corresponding to a transport distance from the divergence point of said first transport route to the trailing edge of a sheet when located in said second transport route during a punching process of said punching means such that the trailing edge of the sheet is transported forward of the divergence point of said first transport route.

37. The sheet processing apparatus according to claim 36, wherein said image forming apparatus includes a copying machine body and a sorter for sorting copy-processed sheets; and said sheet supplier supplies a sheet as discharged from said copying machine body, and said sheet discharger discharges said sheet into said sorter.

38. The sheet processing apparatus according to claim 35, further comprising transport control and simultaneous activating means, for so controlling said transport means, in an instance in which both the stamping process and the punching process are designated by said process designating means, that one end of said sheet in transport is opposite said stamping means, and its corresponding other end is opposite said punching means; wherein said transport control and simultaneous activating means operates both said stamping and punching means simultaneously.

* * * * *